US006055032A

United States Patent [19]

Osterhout et al.

[11] Patent Number: 6,055,032

[45] Date of Patent: Apr. 25, 2000

[54] PLUSH TOY WITH SELECTIVELY POPULATED DISPLAY

[75] Inventors: Ralph F. Osterhout, San Francisco; H. Christian Holljes, San Rafael, both of Calif.

[73] Assignee: OddzOn, Inc., Bedford Hts., Ohio

[21] Appl. No.: 09/019,539

[22] Filed: Feb. 6, 1998

[51] Int. Cl.[7] ..... G02F 1/1333

[52] U.S. Cl. ..... 349/84; 349/142

[58] Field of Search ..... 349/42, 143, 84, 349/142

[56] References Cited

U.S. PATENT DOCUMENTS 4,412,214 10/1983 Tanaka et al. ..... 349/142

5,298,297 3/1994 Takei ..... 349/42

*Primary Examiner*—James A. Dudek

*Attorney, Agent, or Firm*—Laff, Whitesel & Saret, Ltd.

[57] ABSTRACT

A selectively populated grid-matrix LCD included in a plush toy for displaying animated facial expressions in synchronism with audible sounds reproduced by the plush toy. The LCD is selectively populated by including electrodes and associated drive electronics only in select regions of the LCD. Thus, the LCD is capable of displaying complex visual display patterns, having an improved contrast and readability at a reduced cost. The plush toy is interactive in that certain actions performed by a child invoke responses from the plush toy. The plush toy is configured to operate in a variety of modes of operation to simulate the toy being in different moods. In this manner, the toy reacts differently to each action depending on the current mode of operation of the toy.

5 Claims, 19 Drawing Sheets

U3
28
SUBSTRATE
Vss1
Vss
RESB
OPT
IOD7
IOD6
IOD5
IOD4
IOD3
IOD2
IOD1
IOD0
IOC3
IOC2
IOC1
C1
26
seg60
seg59
seg58
seg57
seg56
seg55
seg54
seg53
seg52
seg51
seg50
seg49
seg48
seg47
seg46
seg45
PA0
PA1
PA2
PA3
PA4
PA5
PA6
PA7
factory test point
43
46
48
data
clock
20
74
SEG47
SEG46
SEG45

PLUSH TOY WITH SELECTIVELY POPULATED DISPLAY

FIELD OF THE INVENTION

The present invention relates to grid-matrix liquid crystal displays. More particularly, the present invention relates to plush toys with selectively populated grid-matrix liquid crystal displays for simulating various animated facial expressions.

BACKGROUND INFORMATION

Liquid crystal displays (LCD's) provide many advantages over conventional display devices, such as cathode ray tubes (CRT's). For example, LCD's have a very narrow profile, are relatively light, require less drive circuitry and have relatively low power consumption. Furthermore, from a safety standpoint, most LCD's eliminate the high voltage risk (up to several thousand volts) associated with CRT's.

There are several types of LCD's. However, the general concept of operation is the same for all types. A liquid crystal material is placed in a sealed, light transmissive chamber. Light transmissive electrodes are placed above and below the liquid crystal material. In one type of LCD utilizing what are called twisted nematic liquid crystals, when a sufficient electric potential is applied between the electrodes, the liquid crystal molecules change their alignment. The change in alignment alters the polarization state of light through the liquid crystal material. The chamber or cell essentially acts as a light shutter or valve. It lets either a maximum, minimum or some intermediate amount of light through.

By putting the liquid crystal chamber on top of a reflective backing, and locating a polarizer above the liquid crystal chamber, the top of the liquid crystal chamber will look either black (dim) or white (bright) depending on the alignment of the material (whether the valve is "closed" or "open"). By using a collection of electrodes, such things as letters, numbers, or graphics can be formed by applying appropriate electrical potential across certain electrodes which instruct corresponding liquid crystal areas if the chamber to pass or block light, to in turn form the appropriate visual pattern.

LCD's can be generally divided into two categories: segmented LCD's and grid-matrix LCD's. Segmented LCD's are LCD's in which the electrodes are constructed in certain predetermined shapes of segments. Each segment can be used alone or in combination with other segments to form the desired visual pattern.

A common type of segmented LCD is the so-called "seven segment display." As the name suggests, the "seven segment display" comprises seven elongated rectangular segments arranged into a template or pattern which can form any numeral. Each segment is controlled to simply turn "on" or "off"; that is, transmit maximum light (appears brighter or white) or transmit no light (appears dim or black). The appropriate segments are turned "black" to form the desired numeral if a "normally white" background is used. It is to be understood that depending on the design choice, the background can be either normally black or normally white.

The advantage of a segmented display is the simplicity of the display and associated structure. Only a few segments must be operated to form each visual display pattern. However, the possible visual display patterns available are limited to patterns which incorporate the predetermined segment shapes.

Grid-matrix LCD's can be used to form more complex visual display patterns. Grid-matrix LCD's comprise a large number of very small independent electrodes positioned in a grid pattern in a plane in the liquid crystal material chamber. Each of the independent electrodes typically creates a picture element or pixel. Pixels are generally configured as small square segments arranged in rows and columns forming a matrix. Corresponding numbers of column and row electrodes are correlated with the rows and columns of pixels. An electric potential can therefore be applied to any pixel by the selection of appropriate row and column electrodes and a desired visual display pattern can be generated.

The individual pixels comprise dots or small portions of the overall picture or graphic to be displayed. A graphic control device therefore produces the appropriate instructions to "drive" the matrix of pixels to appropriately reconstruct the image desired. In other word, the control circuitry must send appropriate voltages to appropriate electrodes at appropriate times to form the desired image.

One disadvantage of grid-matrix LCD's is that due to the large number of pixels required to form most visual display patterns, grid-matrix LCD's can be cost prohibitive. Typically, all of the pixels in each row and column in a conventional rectangular grid-matrix LCD are connected to expensive drive electronics so that each and every pixel is operable for producing a visual display pattern. Thus, in order to produce a conventional grid-matrix LCD with a resolution of 20×40, 800 pixels must be evenly spaced across the LCD with each pixel connected to expensive drive electronics.

Graphical LCD's, such as conventional grid-matrix LCD's, are normally multiplexed. As the number of pixels in the display increases, the multiplex ratio (the inverse of the amount of time that an individual pixel is turned on) also increases. As the multiplex ratio of an LCD increases, the contrast ratio and readability of the display goes down. Thus, another disadvantage of conventional grid-matrix LCD's is that the multiplex ratio is relatively high and thus the contrast and readability of a conventional grid-matrix LCD is relatively low.

As a consequence of the large number of pixels and associated drive electronics, conventional grid-matrix LCD's are relatively more expensive than simpler segmented LCD's. Furthermore, the contrast and readability of conventional grid-matrix LCD's is relatively lower than simpler segmented LCD's. Thus, there is a need for a cost effective, high contrast, high readability, grid-matrix LCD which can be used to produce relatively complex visual display patterns.

SUMMARY OF THE INVENTION

These needs and other needs are satisfied by the selectively populated grid-matrix LCD of the present invention. In accordance with the present invention, a selectively populated grid-matrix liquid crystal display for producing visual display patterns is disclosed comprising a light transmissive chamber including a top layer and a bottom layer connected together to form a sealed enclosure, liquid crystal material positioned within the sealed enclosure, a plurality of electrodes for applying an electrical potential across the liquid crystal material, and drive electronics associated with the plurality of electrodes for producing a plurality of pixels.

The pixels are arranged in select regions of the liquid crystal display such that only the select regions of liquid crystal display are operable for producing the visual display designs. Preferably, the select regions of the liquid crystal display are separated from each other by areas which are not operable for producing the visual display designs.

The electrodes are arranged in a plane in a matrix pattern including a plurality of rows and a plurality of columns. The top and bottom layers of the light transmissive chamber each include inner and outer surfaces. The electrodes comprise electrically conductive light transmissive material operably connected to the inner surfaces of the top and bottom layers in predetermined patterns wherein the pattern of the electrically conductive material operably connected to the inner surface of the top layer mirrors the pattern of the electrically conductive material operably connected to the inner surface of the bottom layer.

The LCD further comprises top and bottom polarizer layers with the top polarizer layer arranged on the outer surface of the top layer of the light transmissive chamber and the bottom polarizer layer arranged on the outer surface of the bottom layer of the light tranmissive chamber. Preferably, the top polarizer layer is light transmissive and the bottom polarizer layer is light reflective.

An interactive plush toy is also disclosed comprising a body including a plurality of activatable switches, a face including at least one liquid crystal display for producing facial expressions, control means for controlling operation of the toy, and sound generating means for producing audible sounds. The control means places the toy in one of a plurality of modes of operation and activation of one of the switches causes the sound generating means to produce an audible sound in synchronism with facial expressions animated by the liquid crystal display.

The liquid crystal display includes a light transmissive chamber containing liquid crystal material and a plurality of electrodes for producing a plurality of pixels. The electrodes are arranged substantially in a plane in a matrix pattern including a plurality of rows and a plurality of columns.

In a preferred embodiment, the liquid crystal display comprises a light transmissive chamber comprising a top layer and a bottom layer connected together to form a sealed enclosure, liquid crystal material positioned within the sealed enclosure, a plurality of electrodes for applying an electrical potential across the liquid crystal material, and drive electronics associated with the plurality of electrodes for producing a plurality of pixels. The pixels being arranged in select regions of the liquid crystal display such that only the select regions of liquid crystal display are operable for producing the facial expressions.

In another embodiment, the face comprises three liquid crystal displays positioned beneath a light transmissive cover, wherein each of the three liquid crystal displays is arranged in a select region beneath the light transmissive cover in the area of either an eye or mouth of the face.

Preferably the plush toy includes a three-dimensional facial overlay surrounding the liquid crystal display on the face and the sound producing means comprises a sound generator, a speaker driver and a speaker.

DETAILED DESCRIPTION OF THE PREFERRED EMBODIMENT

In accordance with the present invention, a plush toy having a selectively populated grid-matrix LCD is described that provides distinct advantages when compared to those of the prior art. The invention can best be understood with reference to the accompanying drawing figures.

Figure 1:
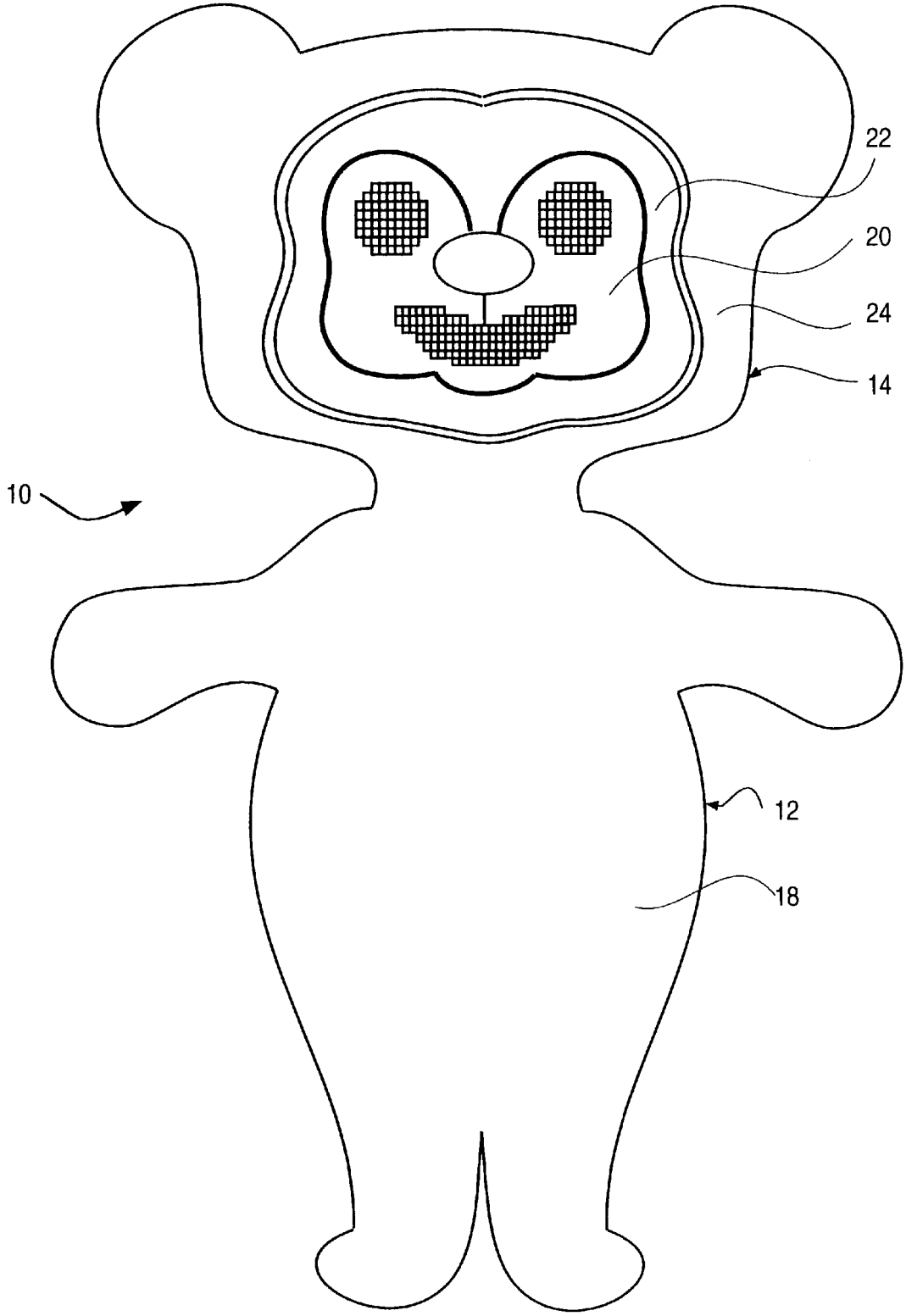
FIG. 1 is perspective view of a plush toy having a selectively populated grid-matrix LCD of the present invention.
Figure 2:
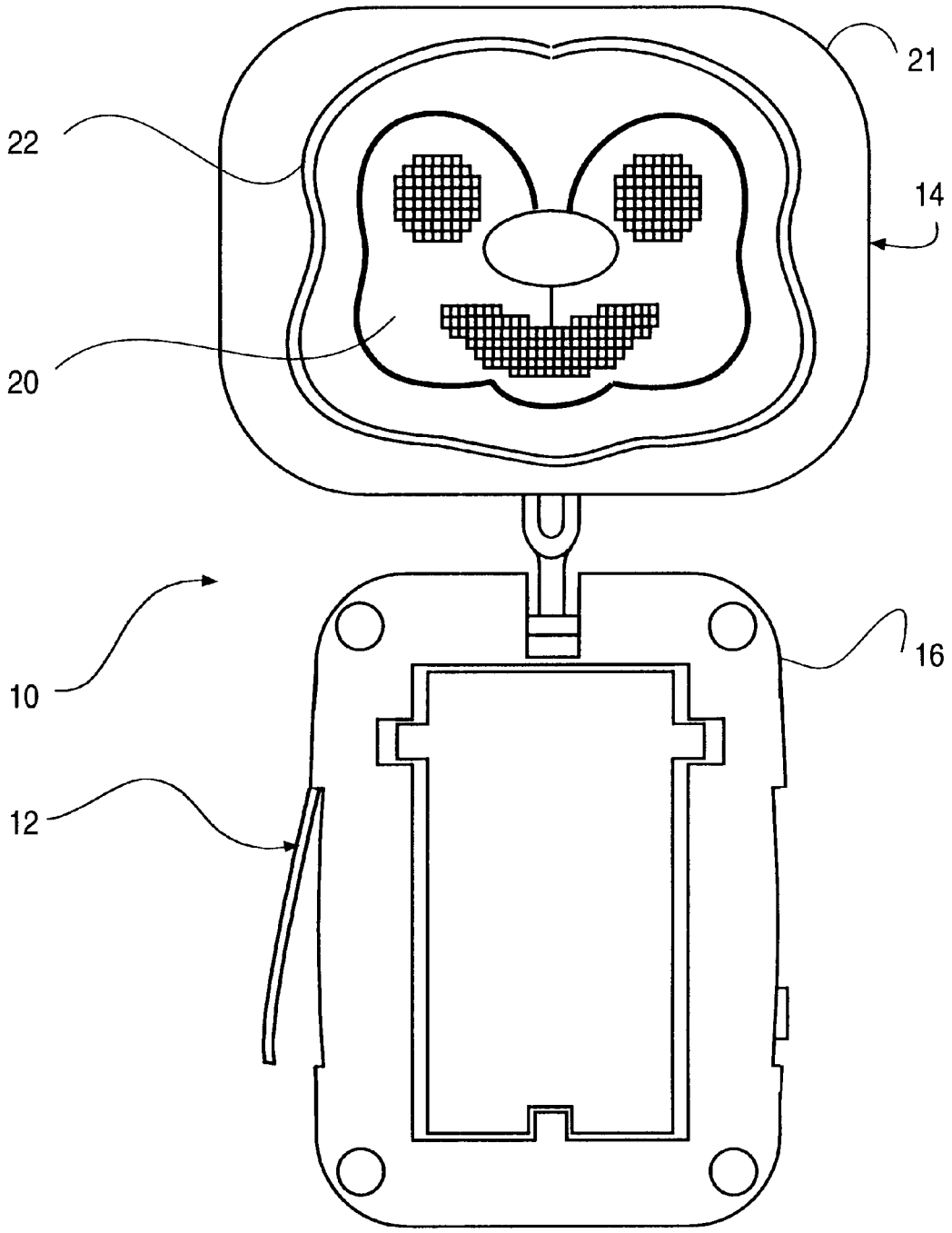
FIG. 2 is perspective view of the internal hard shell electronics housing of the plush toy of FIG. 1.

Referring now to FIGS. 1 and 2, the plush toy of the present invention, generally designated by reference numeral 10, comprises a body 12 and a face 14. The body 12 includes a hard shell body electronics housing 16 covered by a plush outer body 18. The face 14 comprises a selectively populated liquid crystal display (LCD) 20, a hard shell head electronics housing 21, a three-dimensional facial overlay 22 and an plush outer head covering 24.

The plush toy 10 of the present invention is configured to interact with a child by producing audible sounds and animated facial expressions in response to certain actions performed by the child. To this end, the plush toy 10 includes various operational components which are housed within the hard shell body and head electronics housings 16 and 21.

Figure 3:
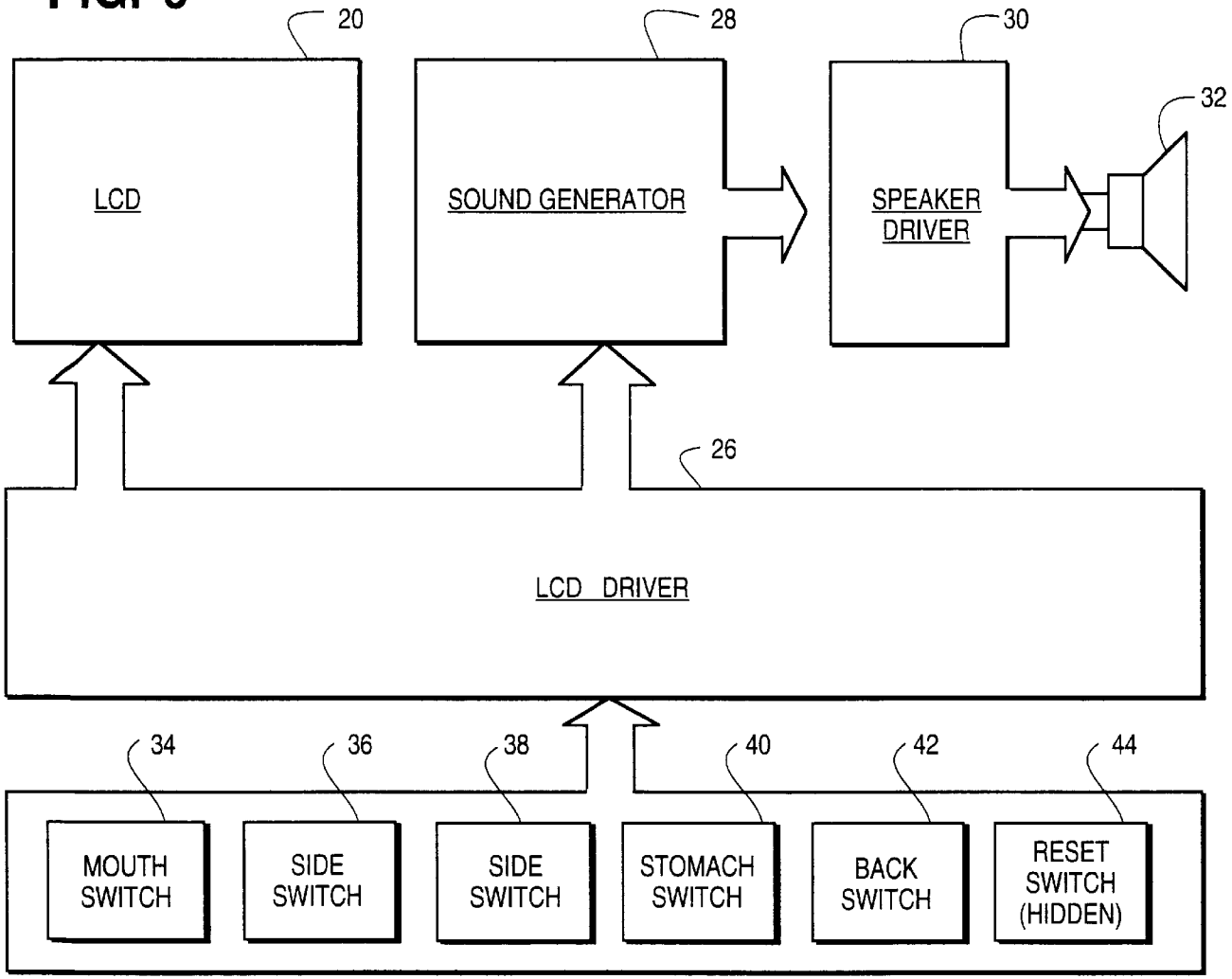
FIG. 3 is block diagram of the operational components of the plush toy of FIG. 1.
Figures 4, 4A, 4B, 4C, 4D:
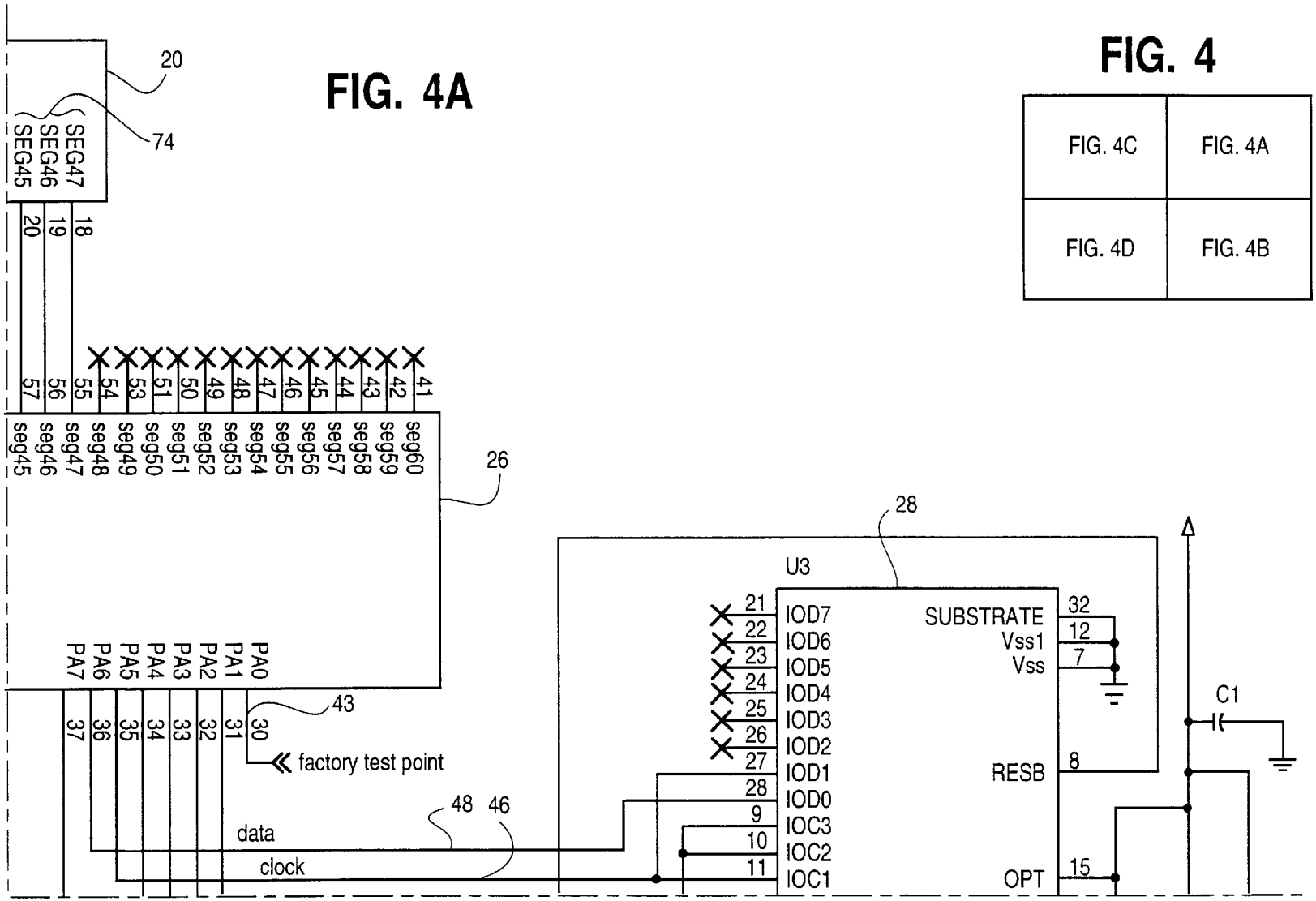
FIG. 4 is a schematic diagram of the operational components of FIG. 3.
Figure 4B:
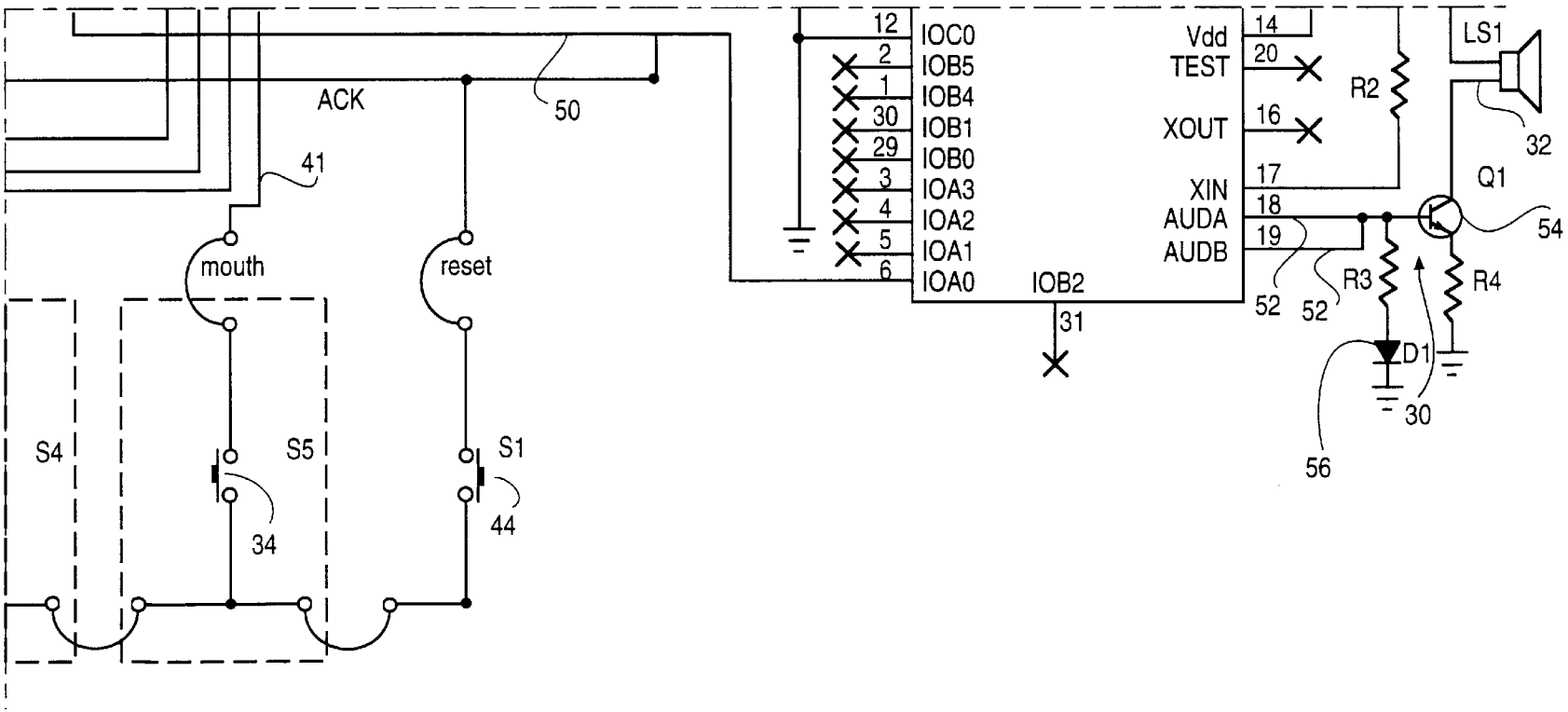
Figure 4C:
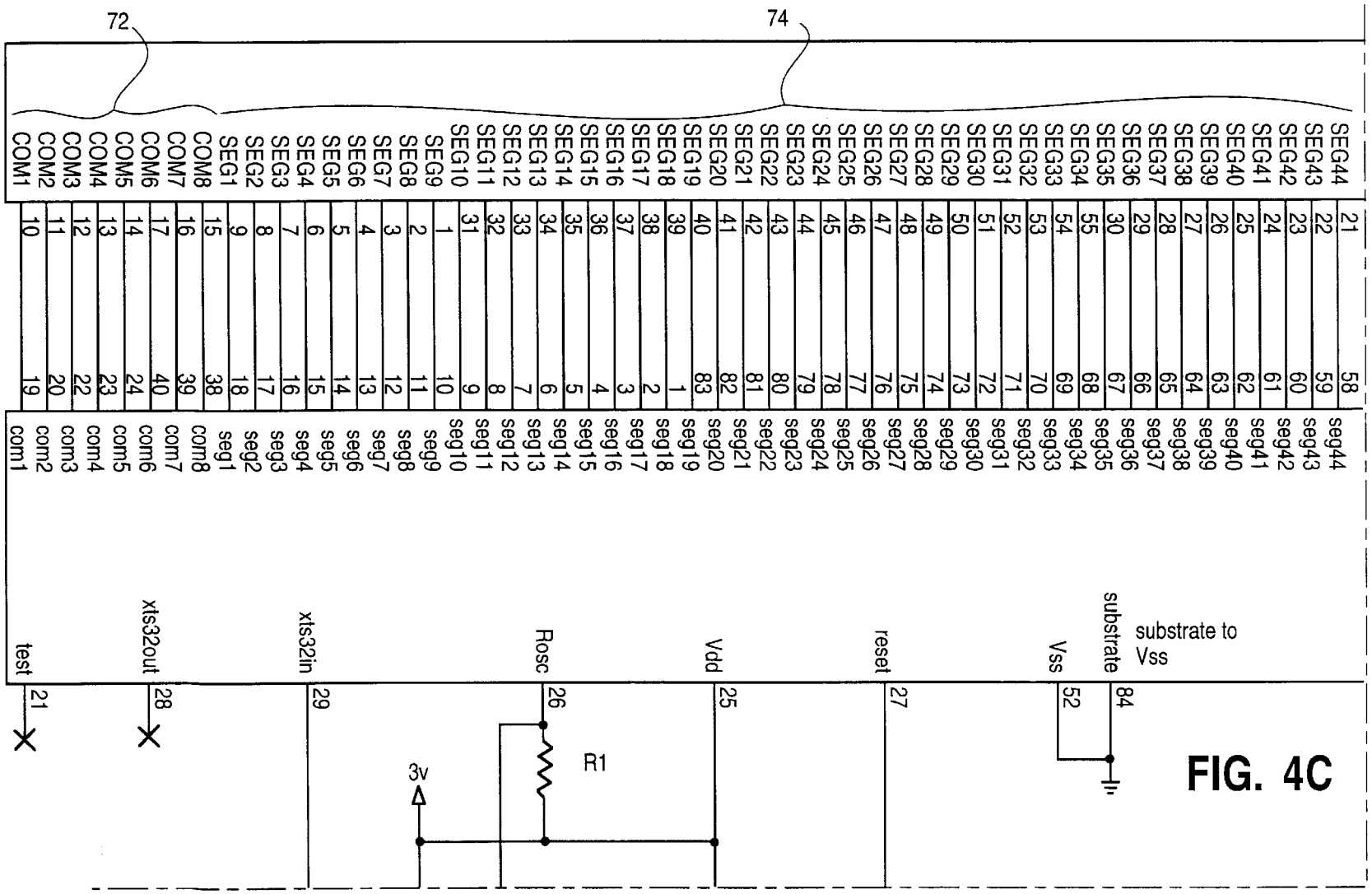
Figure 4D:
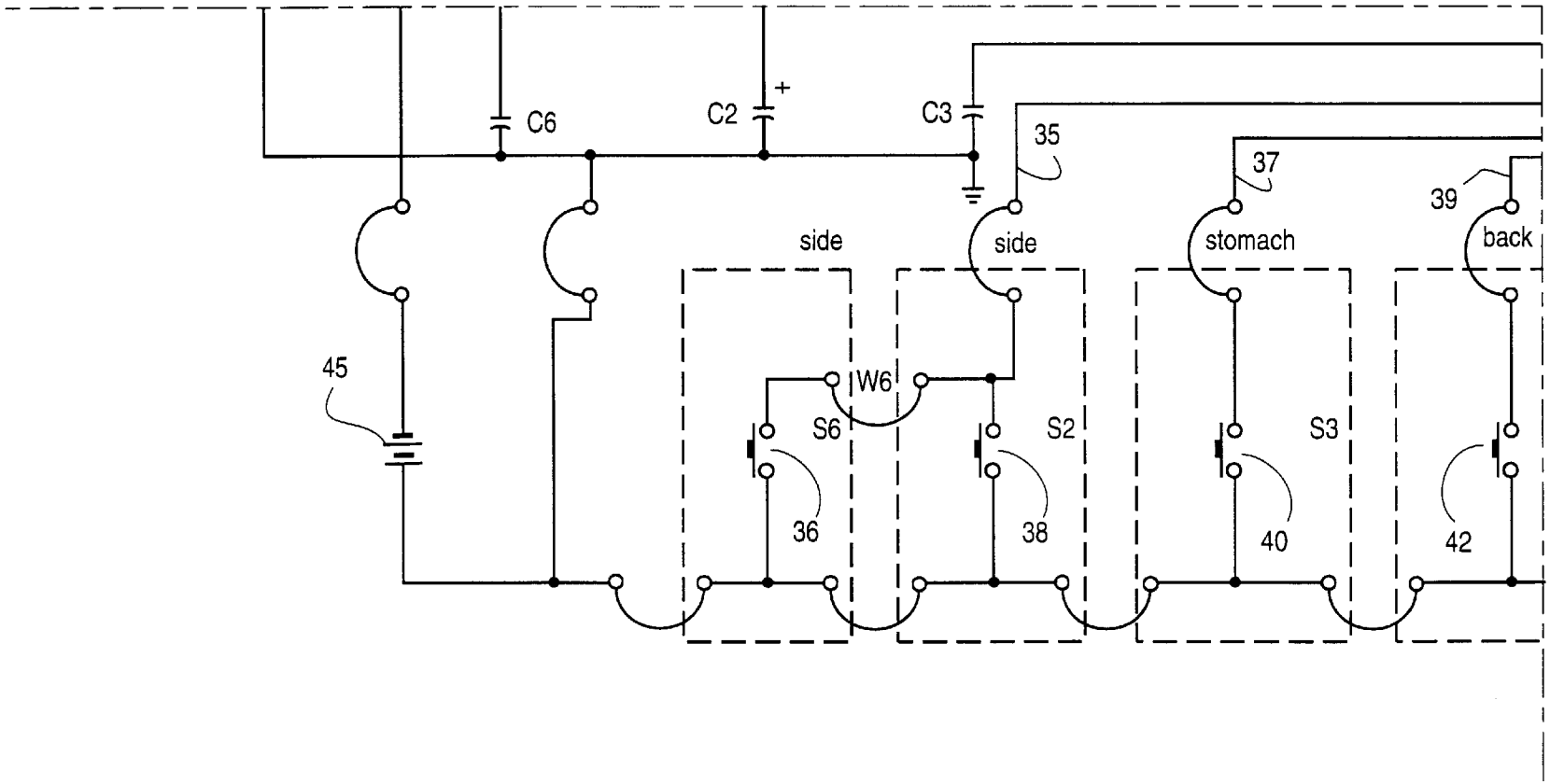

In a preferred embodiment, as illustrated in FIGS. 3 and 4, the operational components of the plush toy 10 comprise an LCD driver/CPU 26, a sound generator 28, a speaker driver 30, a speaker 32, six switches 34–44, a power source, such as a battery 45, and the LCD 20. The switches 34–44 are located on various parts of the body 12 and face 14, beneath the plush outer body 18 and plush outer head covering 24. Switch 44 is configured as a reset switch for resetting operation of the plush toy 10. Switches 32–42 are configured to provide interactive inputs to the operational components of the plush toy 10. Upon activation of one of the switches 34–42, the operational components cause the speaker 32 to produce an audible sound, preferably a spoken phase, and the LCD 20 to produce animated facial expressions in synchronism with the spoken phase.

The plush toy 10 is configured to operate in a variety of modes which are intended to simulate the plush toy 10 being in different moods. Thus, the plush toy 10 reacts differently to certain actions performed by the child depending on the current mode of operation of the plush toy 10.

As shown in FIGS. 3 and 4, the LCD driver/CPU 26 is connected to the switches 34–44, the LCD 20, and the sound generator 28. The LCD driver/CPU 26 is primarily responsible for monitoring the switches 34–44, driving the LCD 20 to display animated facial expressions, determining when a sound is required, and signaling the sound generator 28 to produce an audible sound which is sent by the speaker driver 30 to the speaker 32 for reproduction.

An algorithm for controlling operation of the LCD 20 is permanently written into ROM contained within the LCD driver/CPU 26. The LCD driver/CPU 26 is configured to directly drive the LCD 20 using up to 8 common lines 72 and 60 pixel lines 74. The LCD driver/CPU 26 also has the capability to control eight tri-state I/O lines, four of which 35, 37, 39 and 41 are used to monitor switches 34–44 and three of which 46, 48 and 50 communicate with the sound generator 28. The remaining I/O line 43 is reserved for performing factory testing. The LCD driver/CPU 26 also includes RAM and an RC oscillator which is configured to run at approximately 1 MHz. In the preferred embodiment, the LCD driver/CPU 26 is a Sunplus™ SPLB20A microchip.

The sound generator 28, under the direction of the LCD driver/CPU 26, is primarily responsible for retrieving previously stored audible sounds, such as spoken phases, sending the sounds to the speaker driver 30 which forwards them to the-speaker 32 for reproduction. The LCD driver/CPU 26 drives the LCD 20 to display animated facial expressions in synchronism with the spoken phrases reproduced by the speaker 32. The prerecorded sounds are permanently written into ROM contained within the sound generator 28. The sound generator 28 also includes RAM and an RC clock, which in a preferred embodiment, is configured to run at 3 MHz.

The prerecorded sounds recorded in ROM are non-volatile and are grouped together in ROM in phrase lists. In this way, the sound generator 28 can access different phrase lists depending on the current mode of operation of the plush toy 10. Thus, the individual sounds or phrases selected from the phase lists are customized to the mode of operation of the plush toy 10.

The LCD driver/CPU RAM is configured for temporarily storing counters and flags indicating the current mode of operation and operating status of the plush toy 10. The counters and flags stored in REM are volatile in that they are erased when the plush toy 10 losses power or is reset.

The sound generator 28 is tied to the LCD driver/CPU 26 by three data lines 46, 48 and 50. When the LCD driver/CPU 26 senses activation of one of the switches 34–42, the LCD driver/CPU 26 signals the sound generator 28 to make the appropriate sound by activating line 46. The sound generator 28 responds by acknowledging activation on line 50. Once the sound generator 28 is activated, serial communications are established between the LCD driver/CPU 26 and sound generator 28 on the three data lines 46, 48 and 50. In this manner the LCD driver/CPU 26 determines the mode of operation of the plush toy 10, selects stored sounds for reproduction by the speaker 32, drives the LCD 20 to display animated facial expressions in synchronism with the reproduced sounds and commands the sound generator 28 to make the desired sounds.

In a preferred embodiment, the sound generator 28 is a Sunplus™ SPC121A microchip and the speaker 32 is a 28 mm, 16 ohm speaker. The outputs 52 of the sound generator 28 are tied together to increase the available output current to approximately 9 mA maximum. The output is in the form of an eight bit current sourcing D to A converter included inside the sound generator 28.

Since the voltage compliance of the preferred sound generator output is only about 1.5 v, a speaker driver 30 is necessary for driving the speaker 32. In a preferred embodiment, the speaker driver 32 comprises a transistor 54 configured to class A operation in a current mirror circuit using a silicon diode 56 as a base-emitter junction compensator. This allows transistors of widely varying hfe values to be interchanged in the circuit without the operating point of the class A power output stage shifting significantly. The available output signal to a 16 ohm speaker is about 30 milliwatts which is adequate for the efficient 28 mm speaker employed in the preferred embodiment.

Figure 5:
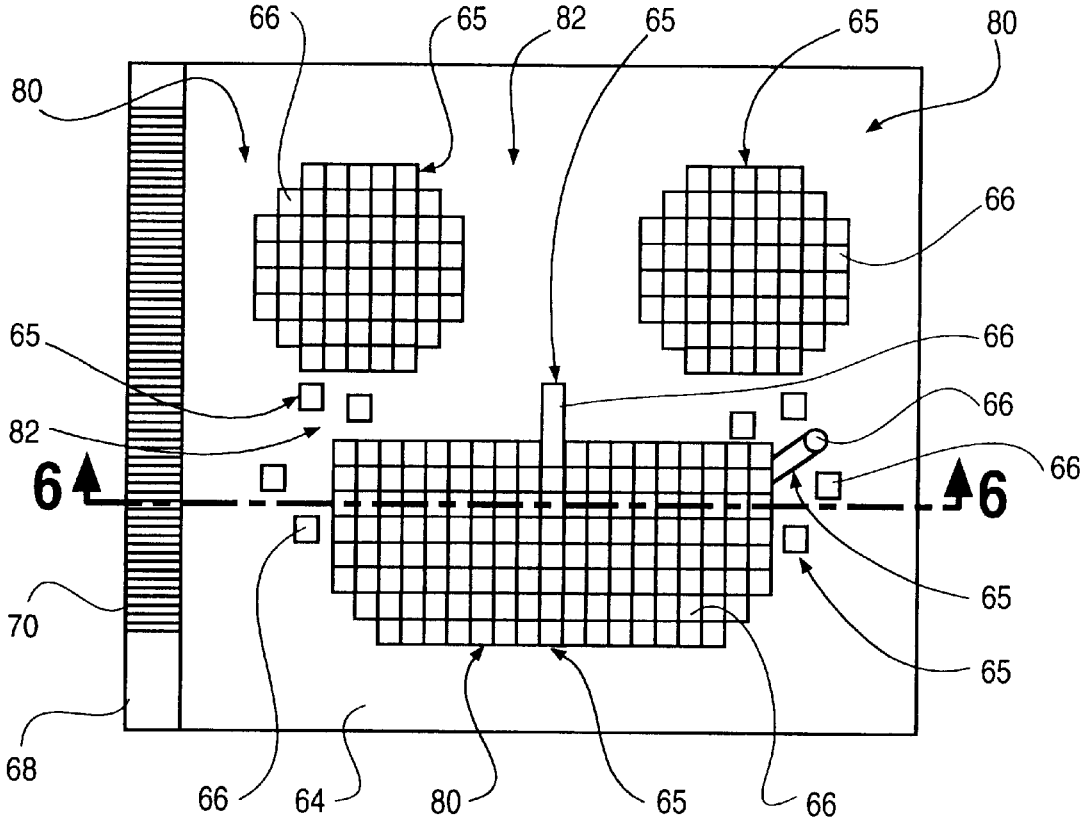
FIG. 5 is a schematic diagram of the electrode pattern of the bottom layer of the LCD of FIG. 3.
Figure 6:
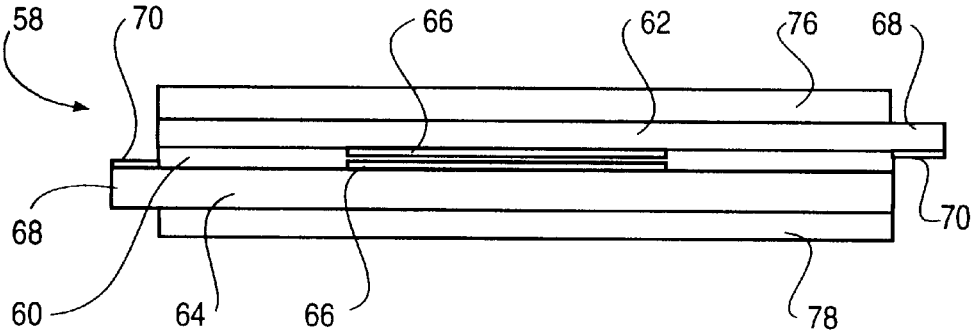
FIG. 6 is a cross-sectional view of the LCD of FIG. 5 taken along line 6—6.

As shown in FIGS. 5 and 6, the LCD 20 is a selectively populated grid-matrix LCD comprising an enclosed liquid crystal display panel 58 containing a liquid crystal material 60 such as twisted nematic liquid crystals. The liquid crystal display panel 58 comprises light transmissive top and bottom layers 62 and 64 connected together to form a sealed enclosure.

Conductive electrodes 66 are applied to the inner surface of the top and bottom layers 62 and 64 to produce pixels 65 in the pattern shown in FIG. 5. Although FIG. 5 only shows the electrode pattern of the bottom layer 64, it should be noted that the electrode pattern of the top layer 62 mirrors that of the bottom layer 64 such that the electrodes 66 on the top and bottom layers 62 and 64 form electrode pairs with the space between the electrode pairs being occupied by liquid crystal material 60.

As illustrated in FIG. 5, the pixels 65 are arranged in a plane in a matrix pattern comprising a plurality of rows and columns. Preferably, the electrodes 66 are made of a light transmissive material such as indium tin oxide. Each electrode 66 is connected to an edge connector 68 via electrical lead lines incorporated into the top and bottom layers 62 and 64. Each edge connector 68 includes exposed electrical lead lines 70 for connecting the electrodes 66 to the LCD driver/CPU 26.

The LCD driver/CPU 26 has 8 common lines 72 and 60 pixel lines 74 for connecting the LCD driver/CPU 26 to the LCD 20. In the preferred embodiment, the electrical lead lines 70 are multiplexed with the 8 common lines 72 and 47 of the 60 pixel lines 74 using known multiplexing techniques. Thus, the LCD driver/CPU 26 can control which electrodes 66 are energized and thus which pixels 65 are lit to form visual display patterns simulating animated facial expressions.

Top and bottom polarizer sheets 76 and 78 are included on the outer surfaces of the top and bottom layers 62 and 64 respectively. Preferably, the top polarizer sheet 76 is light transmissive and the bottom polarizer sheet 78 is reflective. In this manner, light is reflected by the bottom polarizer sheet 78 eliminating the need for an additional back lighting source.

An important aspect of the LCD 20 is that the LCD 20 is selectively populated. This means that electrodes 66 and the associated drive electronics, such as lead, common and pixel lines 70, 72 and 74, are only associated with select pixels 65 located in select regions 80 of the LCD 20. Only those select pixels 65 having associated drive electronics are operable for producing visual display patterns.

In the preferred embodiment, various combinations of select pixels 65 are lit to produce animated facial expressions on the LCD 20 which are synchronized with audible sounds reproduced by the speaker 32. Since the LCD 20 is configured as a grid-matrix of pixels, relatively complex visual display patterns, which are impractical using segmented LCD's, can be produced in the select regions 80 of the LCD 20.

As shown in FIG. 5, the select regions 80 are separated from each other by areas 82 which are not operable for producing visual display patterns. The select regions 80 are located in areas of the LCD 20 corresponding to the eyes and mouth of the face 14 of the plush toy 10.

By only populating the select regions 80 of the face 14 corresponding to the eyes and mouth of the face 14, expensive drive electronics associated with the non-operable areas 82 are eliminated thus reducing the cost of the LCD 20. Furthermore, since pixels located in the non-operable areas 82 need not be controlled by the LCD driver/CPU 26, the multiplex ratio of the LCD 20 is reduced and thus the contrast and readability of the select pixels 65 are increased.

Figure 7:
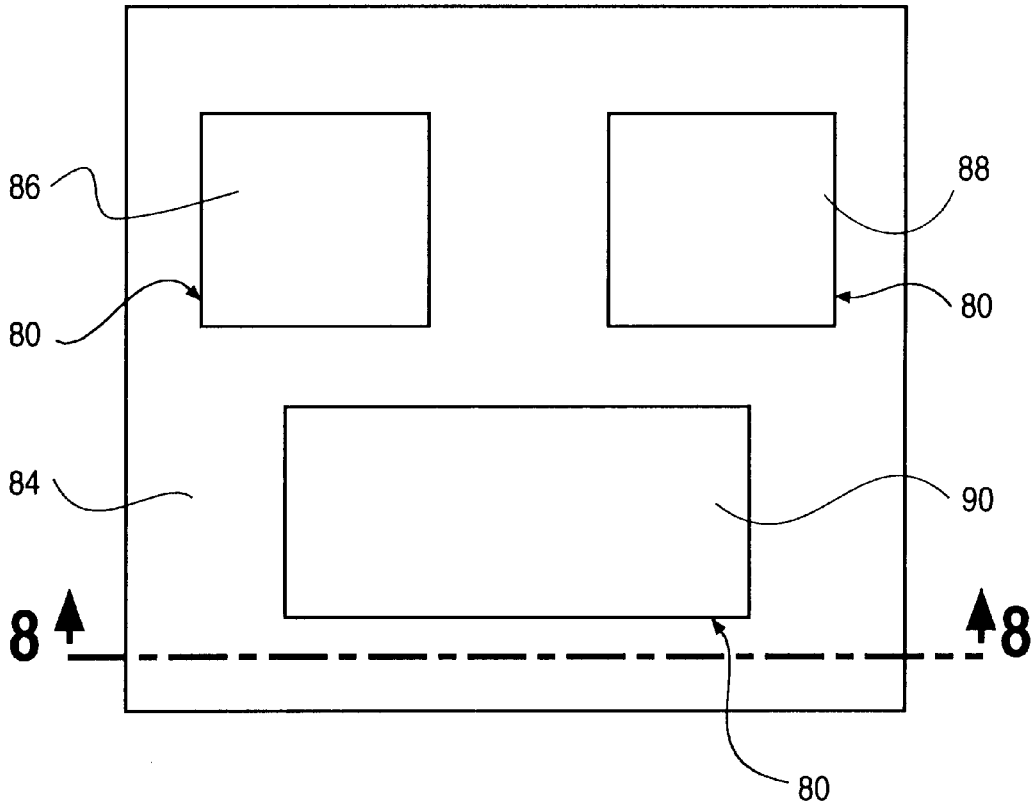
FIG. 7 is a top plan view of another embodiment of the LCD of FIG. 3.
Figure 8:
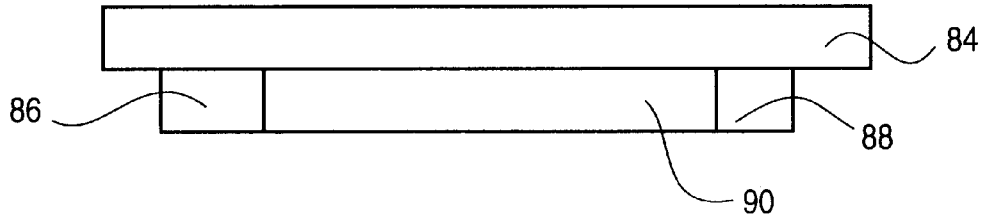
FIG. 8 is a cross-sectional view of the LCD of FIG. 7 taken along line 8—8.
Figure 9:
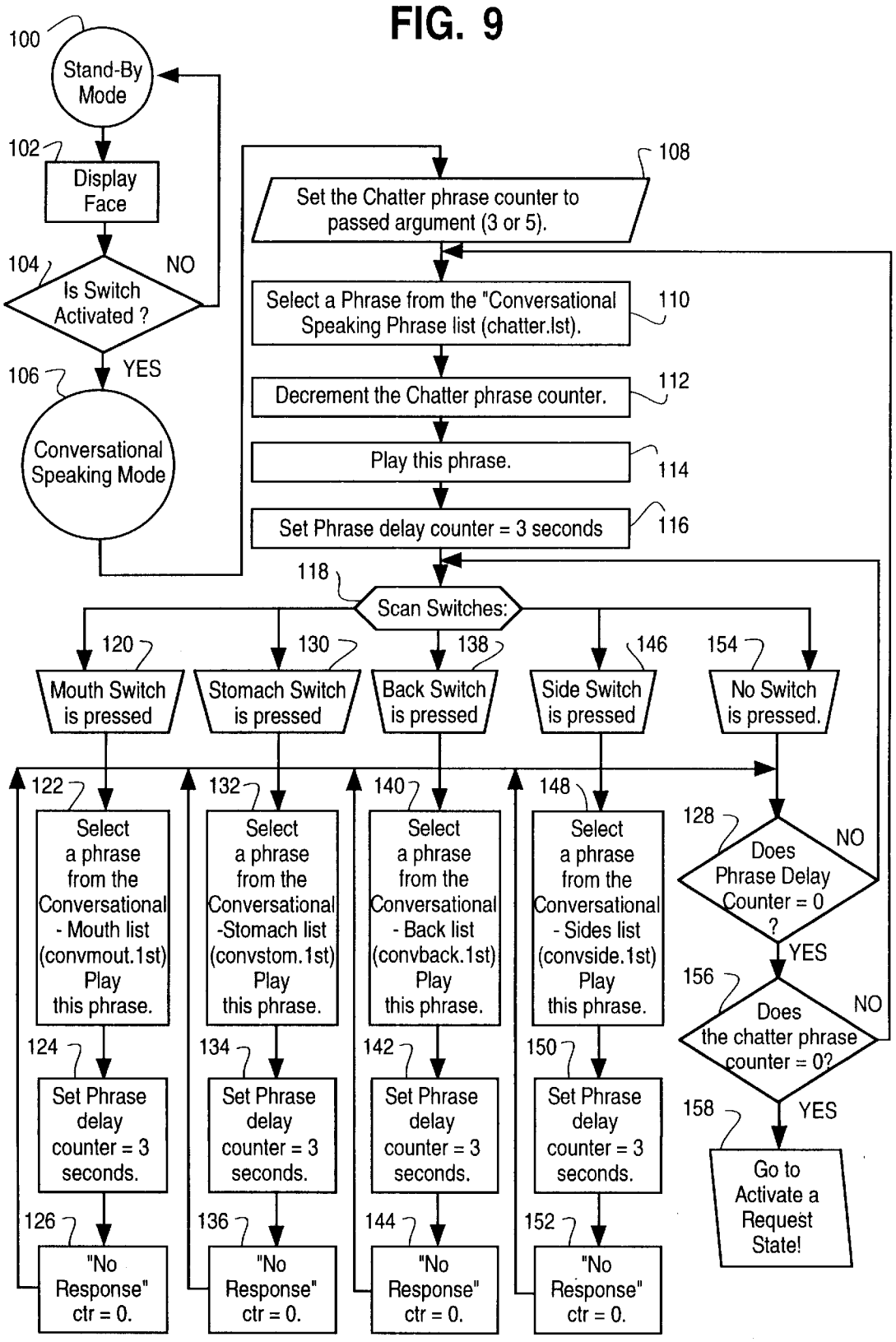
FIG. 9 is a schematic flow chart diagram of the "stand-by" and "conversational speaking" modes of operation of the plush toy of FIG. 1.
Figure 10:
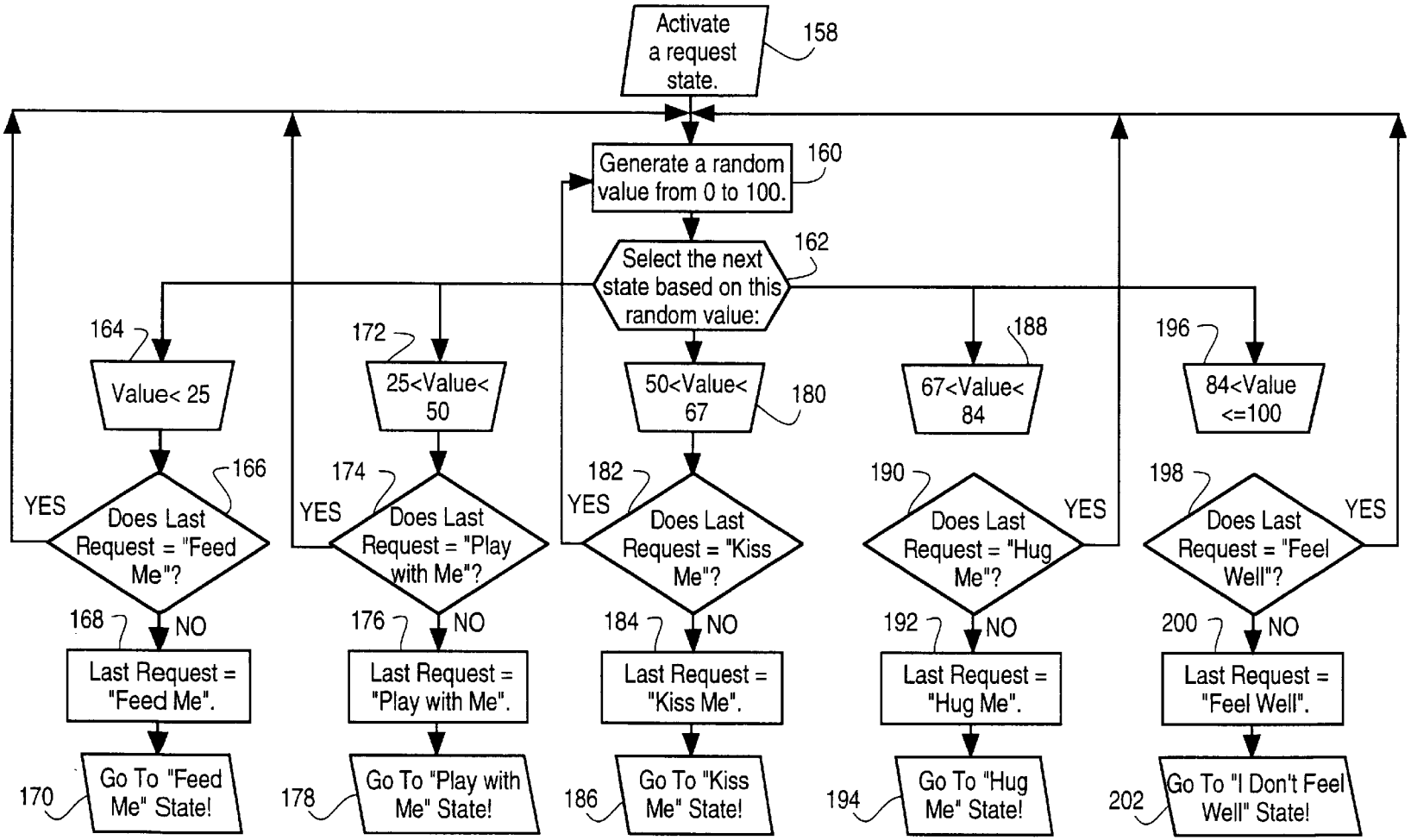
FIG. 10 is a schematic flow chart diagram of the "activate a request" state of the plush toy of FIG. 1.

In an alternative embodiment (shown in FIGS. 7 and 8, each select region 80 comprises an individual grid-matrix LCD 86, 88 and 90, respectively. The individual LCD's 86, 88 and 90 are positioned together under a common protective light transmissive cover 84. In the embodiment shown in FIGS. 7 and 8, the face 14 comprises three individual LCD's 86, 88 and 90, one each for animating the eyes and mouth of the plush toy 10.

The plush toy 10 is configured to interact with a child by producing audible sounds and synchronized facial expressions in response to certain actions performed by a child. To this end, the LCD driver/CPU 26 is configured to monitor the switches 34–42. When a switch 34–42 is activated, the LCD driver/CPU 26 determines which mode of operation the plush toy 10 is operating in and determines an appropriate response.

Switches 34–44 are located on the body 12 and face 14 of the plush toy 10 in various locations beneath the plush outer body 18 and plush outer head covering 24. In the preferred embodiment, switch 34 is located in the face 14 in the mouth area, switch 36 is located in the right side of the body 12, switch 38 is located in the left side of the body 12, switch 40 is located in the stomach area of the body 12 and switch 42 is located on the back of the body 12. In the preferred embodiment, side switches 36 and 38 are tied together to produce the same action. Switch 44 is configured as a reset switch and is positioned in the battery compartment of the body electronic housing 16. The reset switch 44 simultaneously resets the LCD driver/CPU 26 and sound generator 28 when pressed and released.

In the preferred embodiment, the plush toy 10 is configured with 7 different modes of operation. FIGS. 9–15 illustrate the various modes of operation of the plush toy 10. The initial mode of operation is "stand-by" mode (step 100). In "stand-by" mode (step 100), the LCD 20 displays a facial expression (step 102), and the LCD driver/CPU 26 checks to see if a switch 34–42 has been activated (step 104).

The plush toy 10 remains in "stand-by" mode until a switch 34–42 is activated. While in the "stand-by" mode (step 100), the sound generator 28 does not generate sound signals and the speaker 32 does not produce audible sounds. In one embodiment, the LCD driver/CPU 26 is configured to cycle between a "stand-by sleeping" facial expression and a "stand-by awake" facial expression.

If a switch 34–42 is activated, the plush toy 10 enters a "conversational-speaking" mode (step 106). Upon entering the "conversational-speaking" mode (step 106), a chatter phase counter is set (step 108), an audible sound is selected from a "conversational-speaking" phase list (step 110), the chatter phrase counter is decremented (step 112), the selected phrase is played (step 114) by the speaker 32 in synchronism with facial expressions animated on the LCD 20, and a phrase delay counter is set (step 116).

The chatter phase counter and phrase delay counter are counters maintained in RAM included in the LCD driver/CPU 26. The LCD driver/CPU 26 is responsible for determining the mode of operation of the plush toy 10 as well as selecting phrases from the appropriate phrase lists and signaling the sound generator 28 to play the appropriate phrases and driving the LCD 20 to display animated facial expressions synchronized with the selected phrase. The chatter phrase counter is used to count the number of times a phrase from the "conversational-speaking" phrase list is played. The phrase delay is a timer which counts down from its set value to indicate that a switch was not activated for a predetermined amount of time.

After the phrase delay counter is set (step 116), the LCD driver/CPU 26 scans switches 34–42 (step 118). If the mouth switch 34 is activated (step 120), a phrase from the "conversational-mouth" list is selected and played (step 122) in synchronism with facial expressions animated on the LCD 20, the phrase delay counter is reset (step 124), a no-response counter is reset to 0 (step 126) indicating that a switch was activated in the predetermined phrase delay time, the phrase delay counter is checked (step 128) and the LCD driver/CPU 26 re-scans switches 34–42 (step 118).

If the stomach switch 40 is activated (step 130), a phrase from the "conversational-stomach" list is selected and played (step 132) in synchronism with facial expressions animated on the LCD 20, the phrase delay counter is reset (step 134), the no-response counter is reset (step 136), the phrase delay counter is checked (step 128) and the LCD driver/CPU 26 re-scans switches 34–42 (step 118).

If the back switch 42 is activated (step 138), a phrase from the "conversational-back" list is selected and played (step 140) in synchronism with facial expressions animated on the LCD 20, the phrase delay counter is reset (step 142), the no-response counter is reset (step 144), the phrase delay counter is checked (step 128) and the LCD driver/CPU 26 re-scans switches 34–42 (step 118).

If either of the side switches 36 and 38 are activated (step 146), a phrase from the "conversational-side" list is selected and played (step 148) in synchronism with facial expressions animated on the LCD 20, the phrase delay counter is reset (step 150), the no-response counter is reset (step 152), the phrase delay counter is checked (step 128) and the LCD driver/CPU 26 re-scans switches 34–42 (step 118).

If none of the switches 34–42 are activated (step 154), the phrase delay counter is checked (step 128). If the phase delay counter has not counted down to zero, the LCD driver/CPU 26 re-scans switches 34–42 (step 118). If the phrase delay counter has counted down to the zero, the chatter phrase counter is checked (step 156).

If the chatter phrase counter has not counted down to zero, another audible sound is selected from a "conversational-speaking" phase list (step 110), the chatter phrase counter is decremented (step 112), the selected phrase is played (step 114) by the speaker 32 in synchronism with facial expressions animated on the LCD 20, the phrase delay counter is reset (step 116) and the LCD driver/CPU rescans switches 34–42 (step 118).

If the chatter phrase counter has counted down to zero, the plush toy 10 leaves the "conversational-speaking" mode and enters an "activate a request" state (step 158) in which the LCD driver/CPU 26 randomly enters one of the 5 remaining modes of operation.

Upon entering the "activate a request" state (step 158), the LCD driver/CPU 26 generates a random number between 0 and 100 (step 160). The LCD driver/CPU 26 selects the next mode of operation based on the generated random number (step 162). This is accomplished by determining in which predetermined range the generated random number falls.

If the random number is less than 25 (step 164), the LCD driver/CPU 26 checks if the previous mode of operation as the "feed-me" mode (step 166). If the previous mode of operation was the "feed-me" mode, the LCD driver/CPU 26 generates a new random number (step 160) and trys again. If the previous mode of operation was not the "feed-me" mode, a last request flag is set to the "feed-me" mode (step 168) and LCD driver/CPU 26 selects the "feed-me" mode (step 170).

If the random number is between 25 and 50 (step 172), the LCD driver/CPU 26 checks if the previous mode of operation was the "play-with-me" mode (step 174). If the previous mode of operation was the "play-with-me" mode, the LCD driver/CPU 26 generates a new random number (step 160) and trys again. If the previous mode of operation was not the "play-with-me" mode, the last request flag is set to the "play-with-me" mode (step 176) and the LCD driver/CPU 26 selects the "play-with-me" mode (step 178).

If the random number is between 50 and 67 (step 180), the LCD driver/CPU 26 checks if the previous mode of operation was the "kiss-me" mode (step 182). If the previous mode of operation was the "kiss-me" mode, the LCD driver/CPU 26 generates a new random number (step 160) and trys again. If the previous mode of operation was not the "kiss-me" mode, the last request flag is set to the "kiss-me" mode (step 184) and the LCD driver/CPU 26 selects the "kiss-me" mode (step 186).

If the random number is between 67 and 84 (step 188), the LCD driver/CPU 26 checks if the previous mode of operation was the "hug-me" mode (step 190). If the previous mode of operation was the "hug-me" mode, the LCD driver/CPU 26 generates a new random number (step 160) and trys again. If the previous mode of operation was not the "hug-me" mode, the last request flag is set to the "hug-me" mode (step 192) and the LCD driver/CPU 26 selects the "hug-me" mode (step 194).

If the random number is between 84 and 100 (step 196), the LCD driver/CPU 26 checks if the previous mode of operation was the "feel-well" mode (step 198). If the previous mode of operation was the "feel-well" mode, the LCD driver/CPU 26 generates a new random number (step 160) and trys again. If the previous mode of operation was not the "feel-well" mode, the last request flag is set to the "feel-well" mode (step 200) and the LCD driver/CPU 26 selects the "feel-well" mode (step 202).

Figure 11:
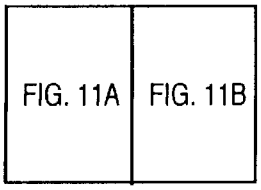
FIG. 11 is a schematic flow chart diagram of the "feed-me" mode of operation of the plush toy of FIG. 1.
Figure 11A:
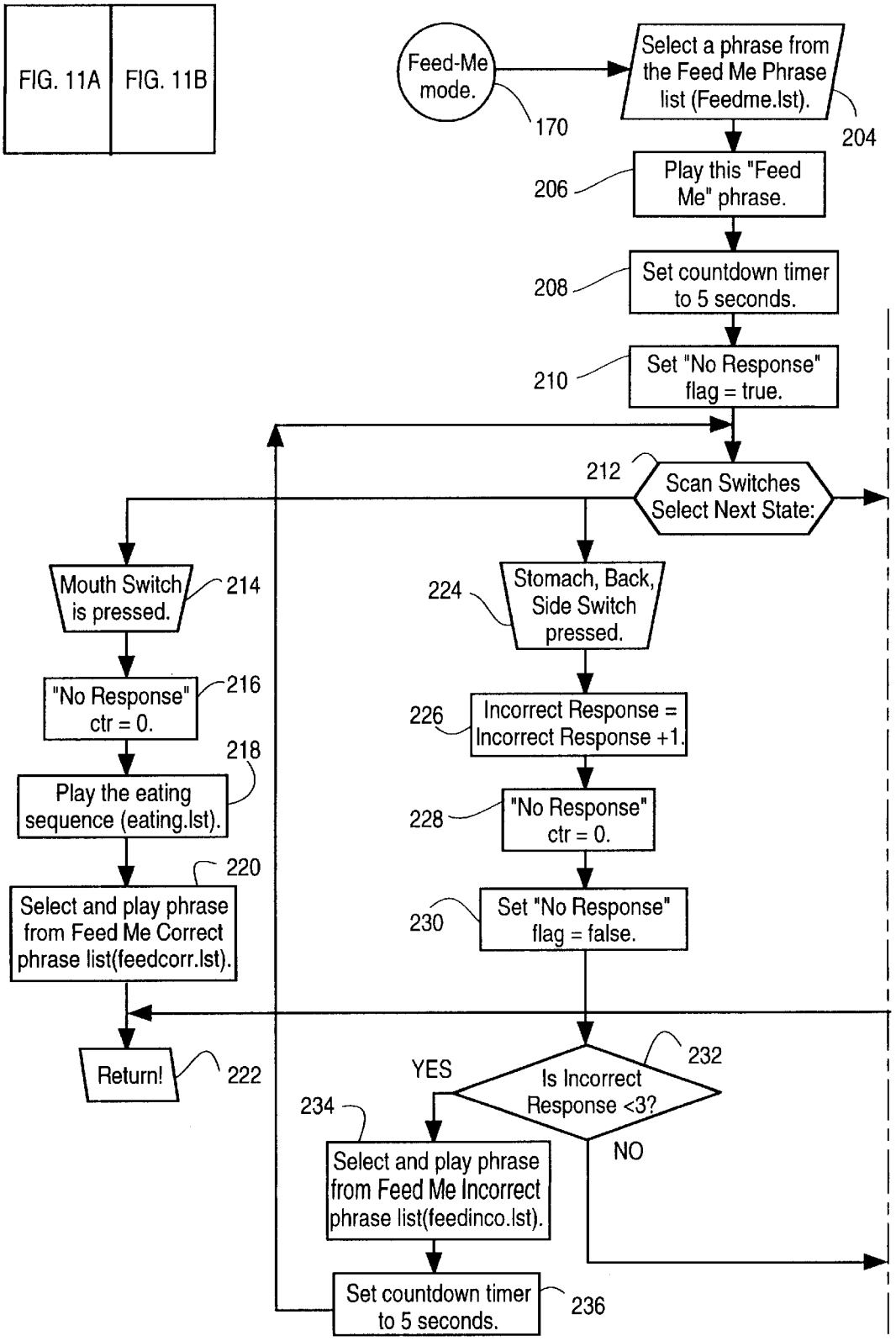
Figure 11B:
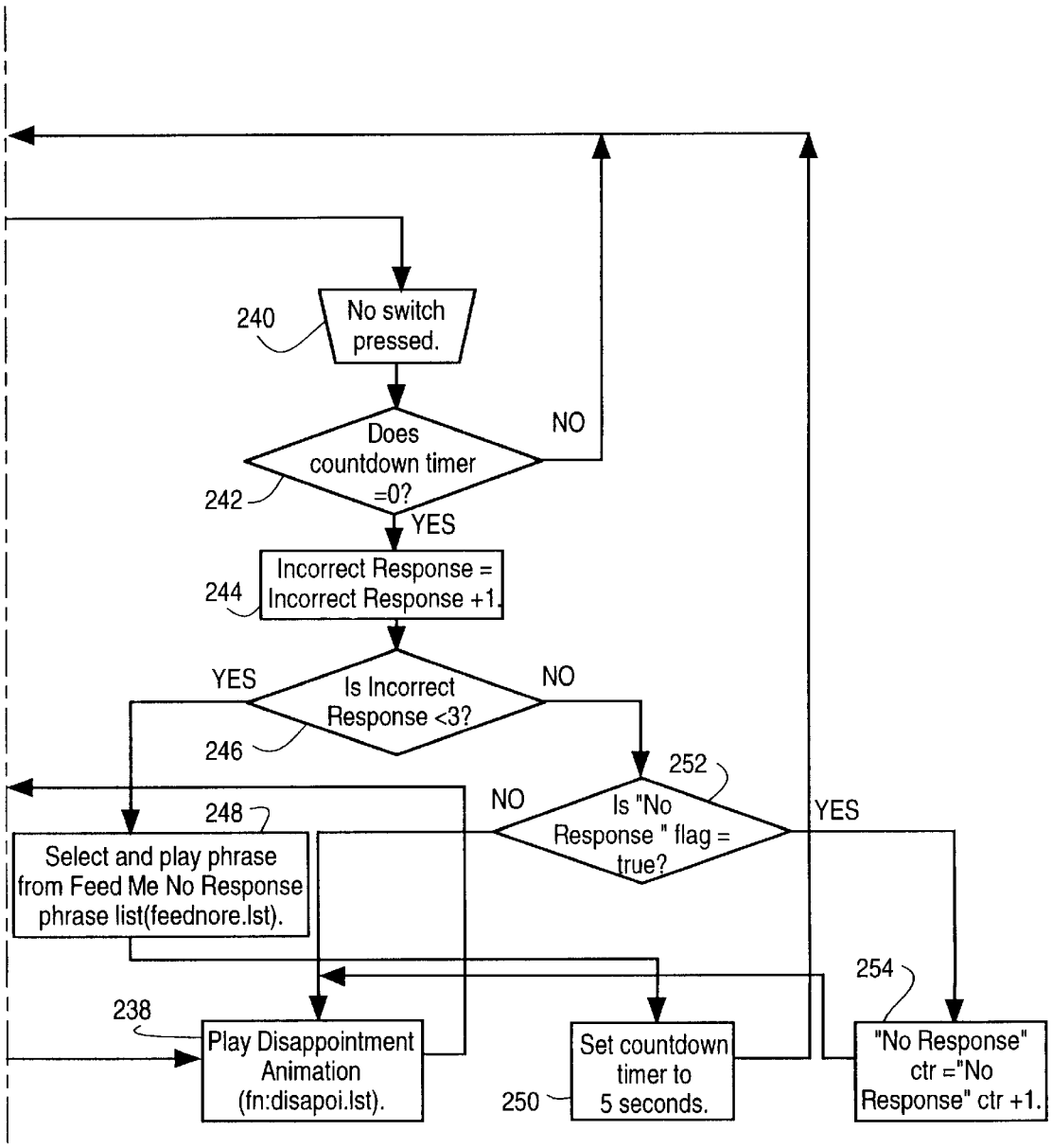

FIG. 11 is a flow chart diagram of the "feed-me" mode of operation. Upon entering the "feed-me" mode (step 170), the LCD driver/CPU 26 selects a phrase from the "feed-me" phase list (step 204), commands the sound generator 28 to play the selected phrase (step 206) in synchronism with facial expressions animated on the LCD 20, sets a countdown timer (step 208), sets a no-response flag to true (step 210), and the LCD driver/CPU 26 scans switches 34–42 (step 212).

If the mouth switch 34 is activated (step 214), the no-response counter is reset (step 216), the sound generator 28 is commanded to forward an eating sound to the speaker driver 30 which forwards the sound to the speaker 32 for reproduction (step 218) in synchronism with facial expressions animated on the LCD 20. The LCD driver/CPU 26 selects a phrase from the "feed-me-correct" phase list (step 220) in synchronism with facial expressions animated on the LCD 20. After this the plush toy 10 returns to the "activate a request" state (step 222).

If any of the stomach, back or side switches 36–42 are activated (step 224), an incorrect response counter is incremented (step 226), the no-response counter is reset to 0 (step 228), the no-response flag is set to false (step 230), and the LCD driver/CPU 26 determines if the incorrect response counter is less than a predetermined number (step 232), which in the preferred embodiment is 3.

If the incorrect response counter is less than 3, the LCD driver/CPU 26 selects and commands the sound generator 28 to play a phrase from the "feed-me-incorrect" phrase list (step 234) in synchronism with facial expressions animated on the LCD 20, resets the countdown time counter (step 236) and re-scans switches 34–42 (step 212).

If the incorrect response counter is not less than 3, a disappointment animation is played on the LCD 20 (step 238) in synchronism with audible sounds played by the speaker 32, and the plush toy 10 returns to the "activate a request" state (step 222).

If no switch is activated (step 240), the LCD driver/CPU 26 determines if the countdown timer has counted down to 0 (step 242). If the countdown timer has not counted down to 0, the LCD driver/CPU 26 re-scans switches 34–42 (step 212). If the countdown time has counted down to 0, the incorrect response counter is incremented (step 244), and the LCD driver/CPU 26 determines if the incorrect response counter is less than 3 (step 246).

If the incorrect response counter is less than 3, the LCD driver/CPU 26 selects and commands the sound generator 28 to play a phrase from the "feed-me-no-response" phrase list (step 248) in synchronism with facial expressions animated on the LCD 20, resets the countdown timer (step 250) and re-scans switches 34–42 (step 212). If the incorrect response counter is not less than 3, the LCD driver/CPU 26 determines if the no-response flag is true (step 252).

If the no-response flag is true, the LCD driver/CPU 26 increments the no-response counter (step 254), a disappointment animation is played on the LCD 20 (step 238) in synchronism with audible sounds played by the speaker 32, and the plush toy 10 returns to the "activate a request" state (step 222). If the no-response flag is not true, a disappointment animation is played on the LCD 20 (step 238) in synchronism with audible sounds played by the speaker 32, and the plush toy 10 returns to the "activate a request" state (step 222), without incrementing the no-response counter.

Figure 12:
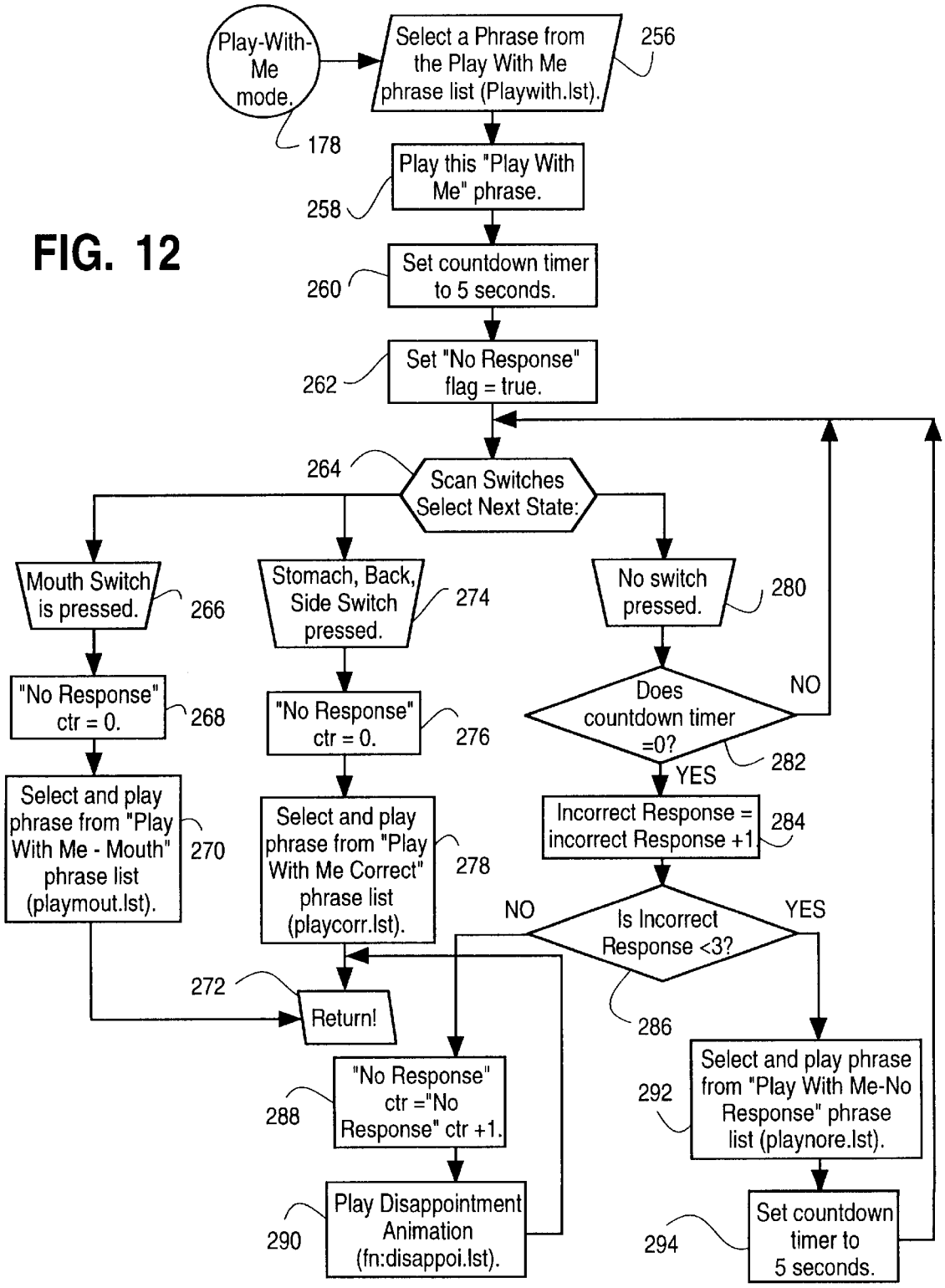
FIG. 12 is a schematic flow chart diagram of the "kiss-me" mode of operation of the plush toy of FIG. 1.

FIG. 12 is a flow chart diagram illustrating the "play-with-me" mode of operation. Upon entering the "play-with-me" mode (step 178), the LCD driver/CPU 26 selects a phrase from the "play-with-me" phrase list (step 256), commands the sound generator 28 to play the selected phrase (step 258) in synchronism with facial expression animated on the LCD 20, sets the countdown timer (step 260), sets the no-response flag to true (step 262), and the LCD driver/CPU 26 scans switches 34–42 (step 264).

If the mouth switch 34 is activated (step 266), the no-response counter is reset to 0, (step 268), the LCD driver/CPU 26 selects a phrase from the "play-with-me-mouth" phrase list (step 270) and commands the sound generator 28 to play the selected phrase in synchronism with facial expressions anmiated on the LCD 20, and the plush toy 10 returns to the "activate a request" state (step 272).

If any of the stomach, back or side switches 36–42 are activated (step 274), the no-response counter is reset to 0 (step 276), the LCD driver/CPU 26 selects a phrase from the "play-with-me-correct" phrase list (step 278) and commands the sound generator 28 to play the selected phrase in synchronism with facial expressions animated on the LCD 20, and the plush toy 10 returns to the "activate a request" state (step 272).

If no switch is activated (step 280), the LCD driver/CPU 26 determines if the countdown timer has counted down to 0 (step 282). If the countdown timer has not counted down to 0, the LCD driver/CPU 26 re-scans switches 34–42 (step 264). If the countdown timer has counted down to 0, the incorrect response counter is incremented (step 284) and the LCD driver/CPU 26 determines if the incorrect response counter is less than 3 (step 286).

If the incorrect response counter is not less than 3, the no-response counter is incremented (step 288), a disappointment animation is played on the LCD 20 (step 290) in synchronism with audible sounds played by the speaker 32, and the plush toy 10 returns to the "activate a request" state (step 272).

If the incorrect response counter is less than 3, the LCD drive/CPU 26 selects a phrase from the "play-with-me-no-response" list (step 292) and commands the sound generator 28 to play the selected phrase in synchronism with facial expressions animated in the LCD 20, the countdown timer is reset (step 294) and the LCD driver/CPU re-scans switches 34–42 (step 264).

Figure 13:
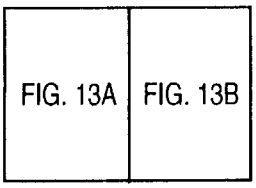
FIG. 13 is a schematic flow chart diagram of the "feel-well" mode of operation of the plush toy of FIG. 1.
Figure 13A:
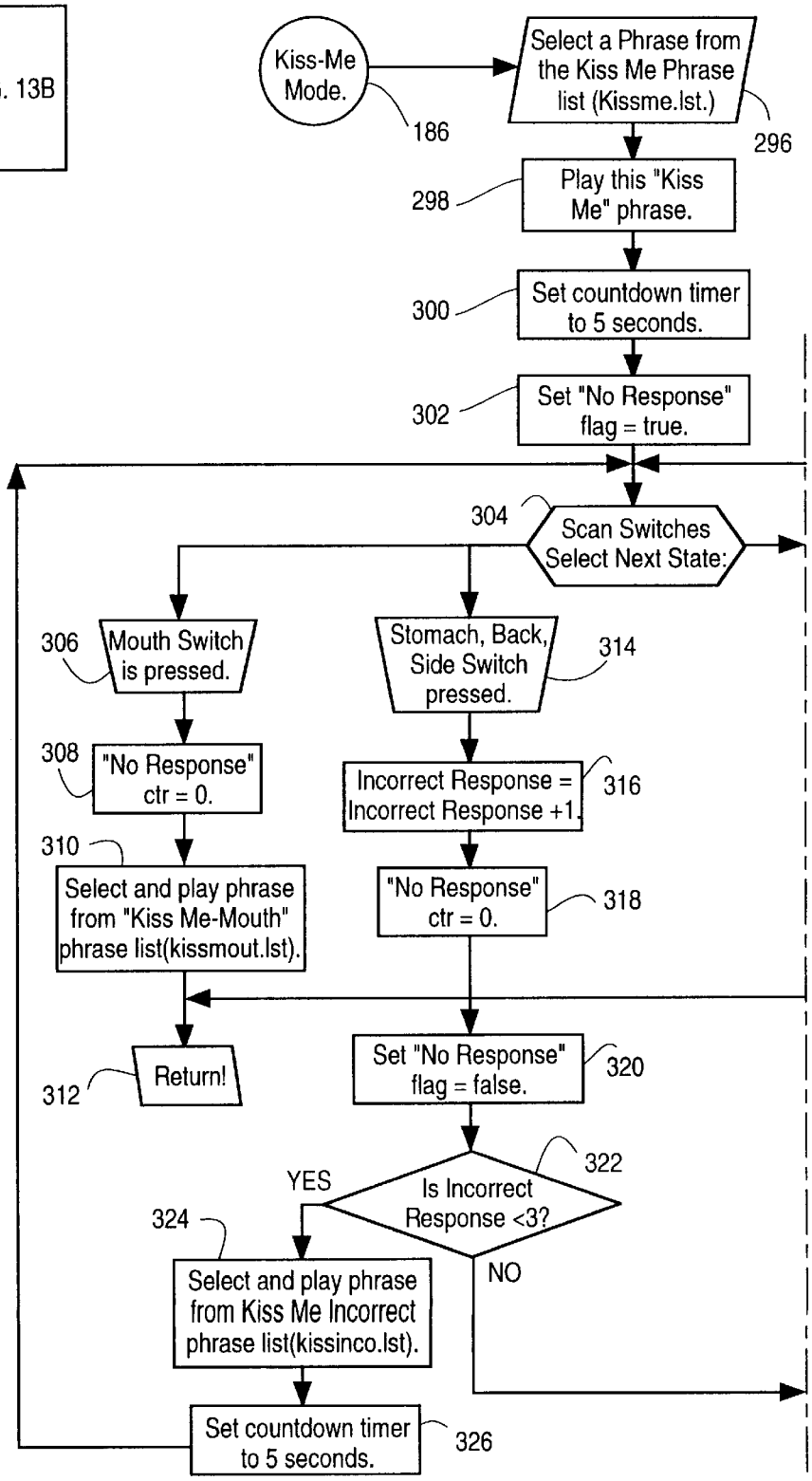
Figure 13B:
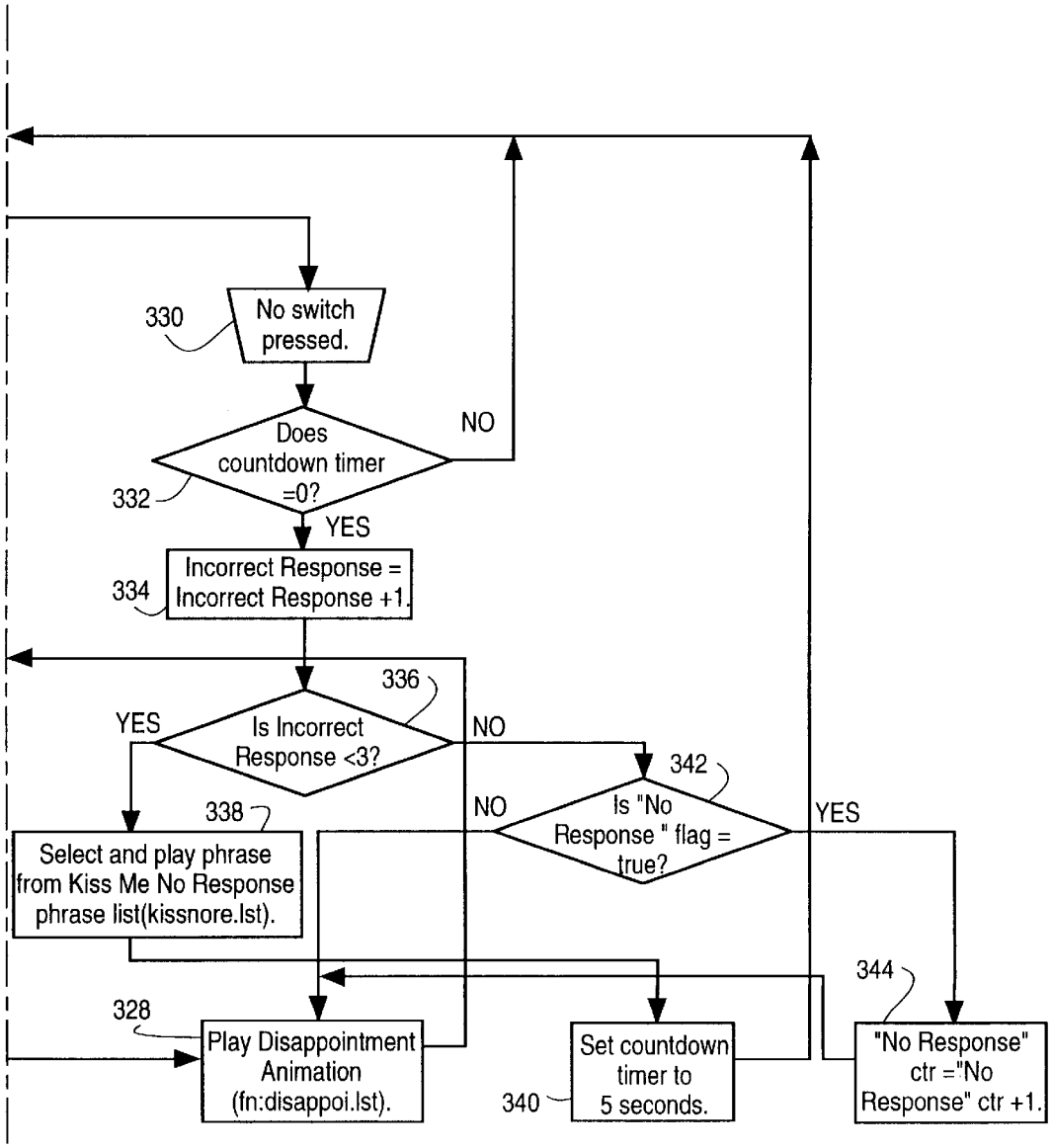

FIG. 13 is a flow chart diagram illustrating the "kiss-me" mode of operation. Upon entering the "kiss-me" mode of operation (step 186), the LCD driver/CPU 26 selects a phrase from the "kiss-me" phrase list (step 296), commands the sound generator 28 to play the selected phrase (step 298) in synchronism with facial expressions animated on the LCD 20, sets the countdown timer (step 300), sets the no-response flag to true (step 302), and the LCD driver/CPU 26 scans switches 34–42 (step 304).

If the mouth switch 34 is activated (step 306), the no-response counter is reset to 0 (step 308), the LCD driver/CPU 26 selects a phrase from the "kiss-me-mouth" phrase list (step 310) and commands the sound generator 28 to play the selected phrase in synchronism with facial expressions animated on the LCD 20, and the plush toy 10 returns to the "activate a request" state (step 312).

If any of the stomach, back or side switches 36–42 are activated (step 314), the incorrect response counter is incremented (step 316), the no-response counter is reset to 0 (step 318), the no-response flag is set to false (step 320), and the sound generator 28 determines if the incorrect response counter is less than 3 (step 322).

If the incorrect response counter is less than 3, the LCD driver/CPU 26 selects a phrase from the "kiss-me-incorrect" phrase list (step 324) and commands the sound generator 28 to play the selected phrase in synchronism with facial expressions animated on the LCD 20, the countdown timer is reset (step 326) and the LCD driver/CPU 26 re-scans switches 34–42 (step 304).

If the incorrect response counter is not less than 3, a disappointment animation is played on the LCD 20 (step 328) in synchronism with audible sounds played by the speaker 32, and the plush toy 10 returns to the "activate a request" state (step 312).

If no switch is activated (step 330), the LCD driver/CPU 26 determines if the countdown timer has counted down to 0 (step 332). If the countdown timer has not counted down to 0, the LCD driver/CPU 26 re-scans switches 34–42 (step 304). If the countdown timer has counted down to 0, the incorrect response counter is incremented (step 334), and the LCD driver/CPU 26 determines if the incorrect response counter is less than 3 (step 336). If the incorrect response counter is less than 3, the LCD driver/CPU 26 selects a phrase from the "kiss-me-no-response" phrase list (step 338) and commands the sound generator 28 to play the selected phrase in synchronism with facial expressions animated on the LCD 20, the countdown timer is reset (step 340) and the LCD driver/CPU 26 re-scans switches 34–42 (step 304).

If the incorrect response counter is not less than 3, the LCD driver/CPU 26 determines if the no-response flag is true (step 342). If the no-response flag is true, the no-response counter is incremented (step 344), a disappointment animation is played on the LCD 20 (step 328) in synchronism with audible sounds played by the speaker 32, and the plush toy 10 returns to the "activate a request" state (step 312).

If the incorrect response flag is not true, a disappointment animation is played on the LCD 20 (step 328) in synchronism with audible sounds played by the speaker 32, and the plush toy 10 returns to the "activate a request" state (step 312), without incrementing the no-response counter.

Figure 14:
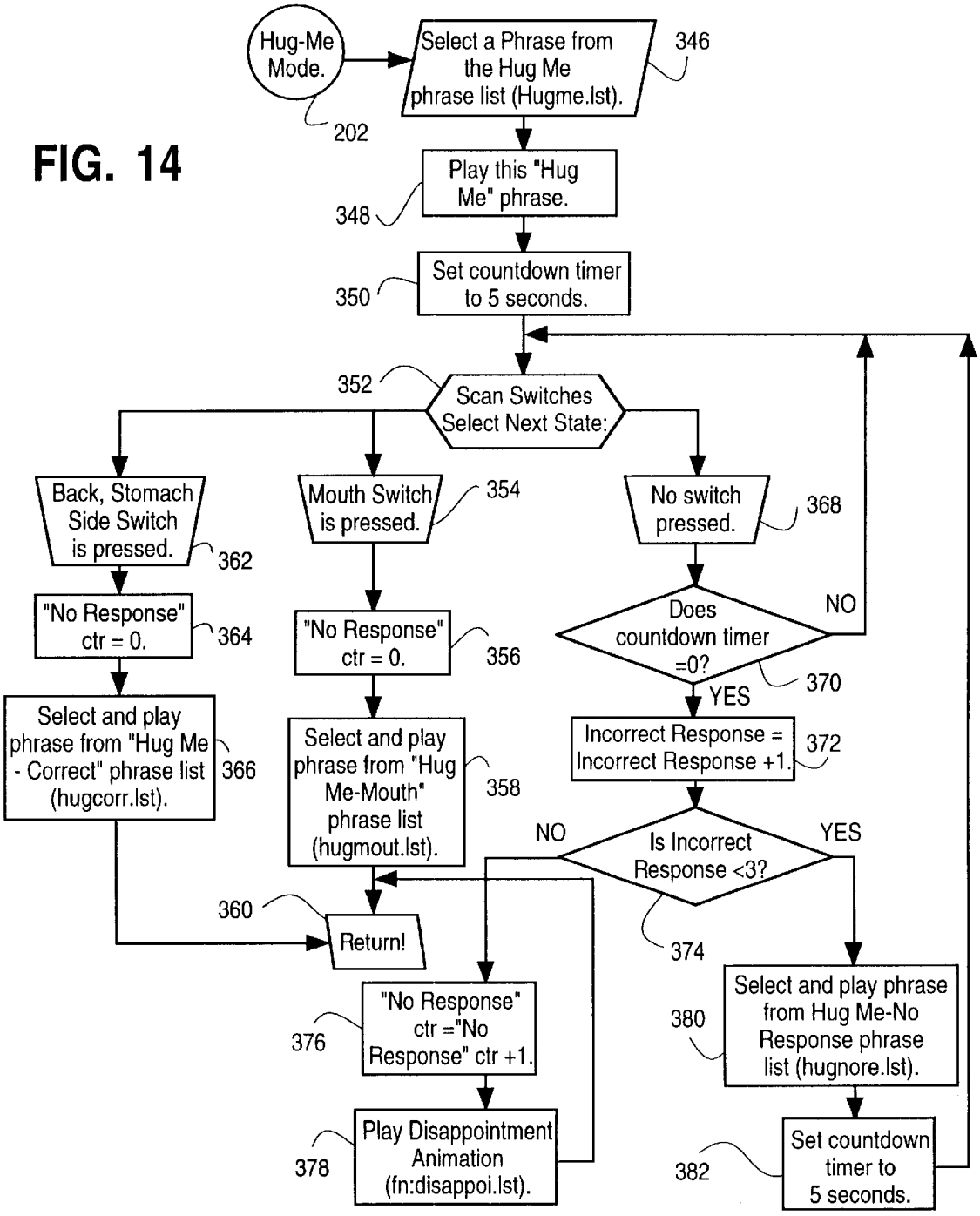
FIG. 14 is a schematic flow chart diagram of the "play-with-me" mode of operation of the plush toy of FIG. 1.

FIG. 14 is a flow chart diagram of the "hug-me" mode of operation. Upon entering the "hug-me" mode of operation (step 202), the LCD driver/CPU 26 selects a phrase from the "hug-me" phrase list (step 346), commands the sound generator 28 to play the selected phrase (step 348) in synchronism with facial expressions animated on the LCD 20, sets the countdown timer (step 350), and the LCD driver/CPU 26 scans switches 34–42 (step 352).

If the mouth switch 34 is activated (step 354), the no-response counter is reset to 0 (step 356), the LCD driver/CPU 26 selects a phrase from the "hug-me-mouth" phrase list (step 358) and commands the sound generator 28 to play the selected phrase in synchronism with facial expressions animated on the LCD 20, and the plush toy 10 returns to the "activate a request" state (step 360).

If any of the stomach, back or side switches 36–42 are activated (step 362), the no-response counter is reset to 0 (step 364), the LCD driver/CPU 26 selects a phrase from the "hug-me-correct" phrase list (step 366) and commands the sound generator 28 to play the selected phrase in synchronism with facial expressions animated on the LCD 20, and the plush toy returns to the "activate a request" state (step 360).

If no switch is activated (step 368), the LCD driver/CPU 26 determines if the countdown timer has counted down to 0 (step 370). If the countdown timer has not counted down to 0, the LCD driver/CPU 26 re-scans switches 34–42 (step 352).

If the countdown timer has counted down to 0, the LCD driver/CPU 26 increments the incorrect response counter (step 372) and determines if the incorrect response counter is less than 3 (step 374). If the incorrect response counter is not less than 3, the no-response counter is incremented (step 376), a disappointment animation is played on the LCD 20 (step 378) in synchronism with audible sounds played by the speaker 32, and the plush toy 10 returns to the activate a request" state (step 360).

If the incorrect response counter is less than 3, the LCD driver/CPU 26 selects a phrase from the "hug-me-no-response" phrase list (step 380) and commands the sound generator 28 to play the selected phrase in synchronism with facial expressions animated on the LCD 20, resets the countdown timer (step 382) and the LCD driver/CPU 26 rescans switches 34–42 (step 352).

Figure 15:
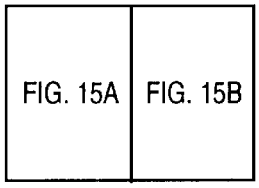
FIG. 15 is a schematic flow chart diagram of the "hug-me" mode of operation of the plush toy of FIG. 1.
Figure 15A:
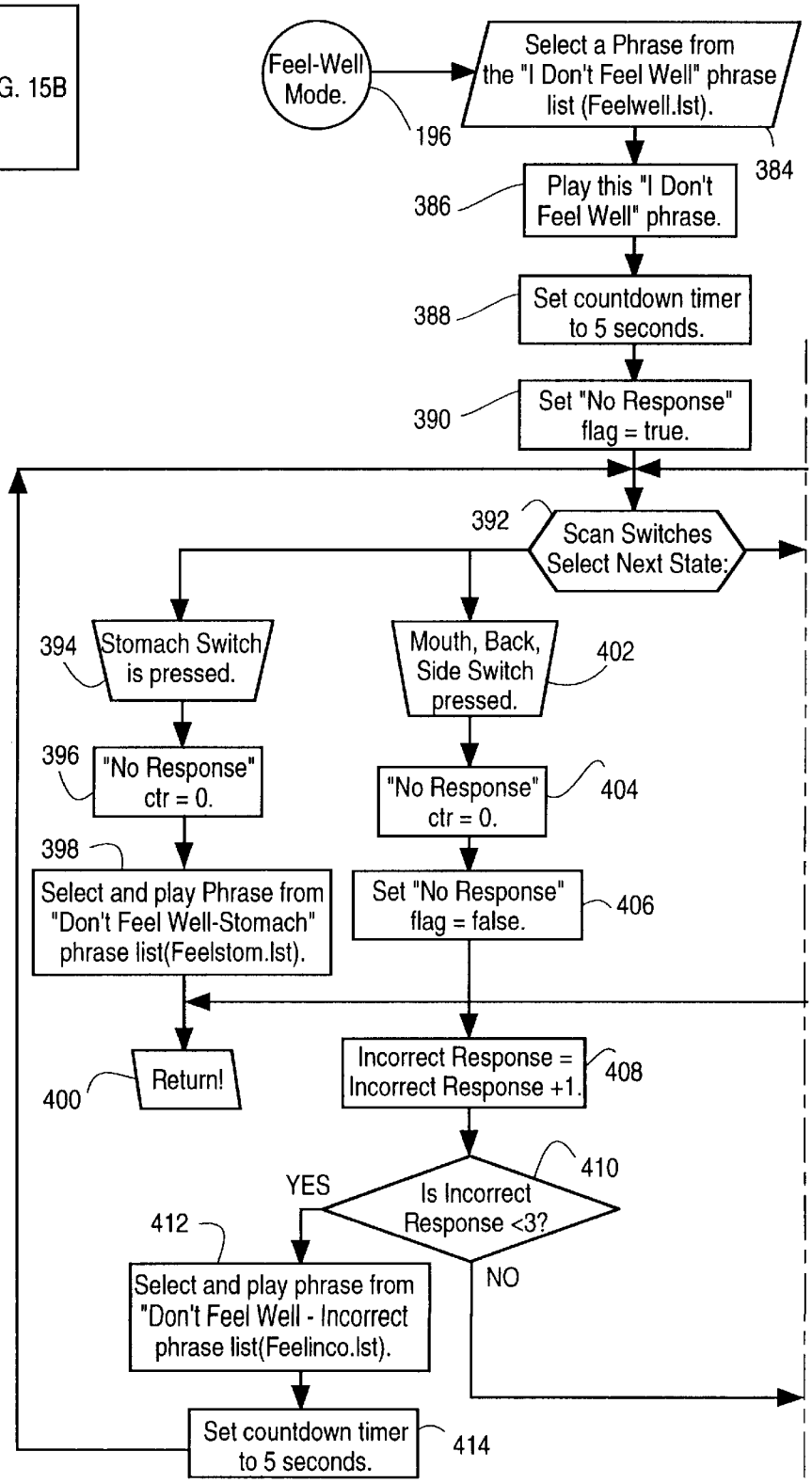
Figure 15B:
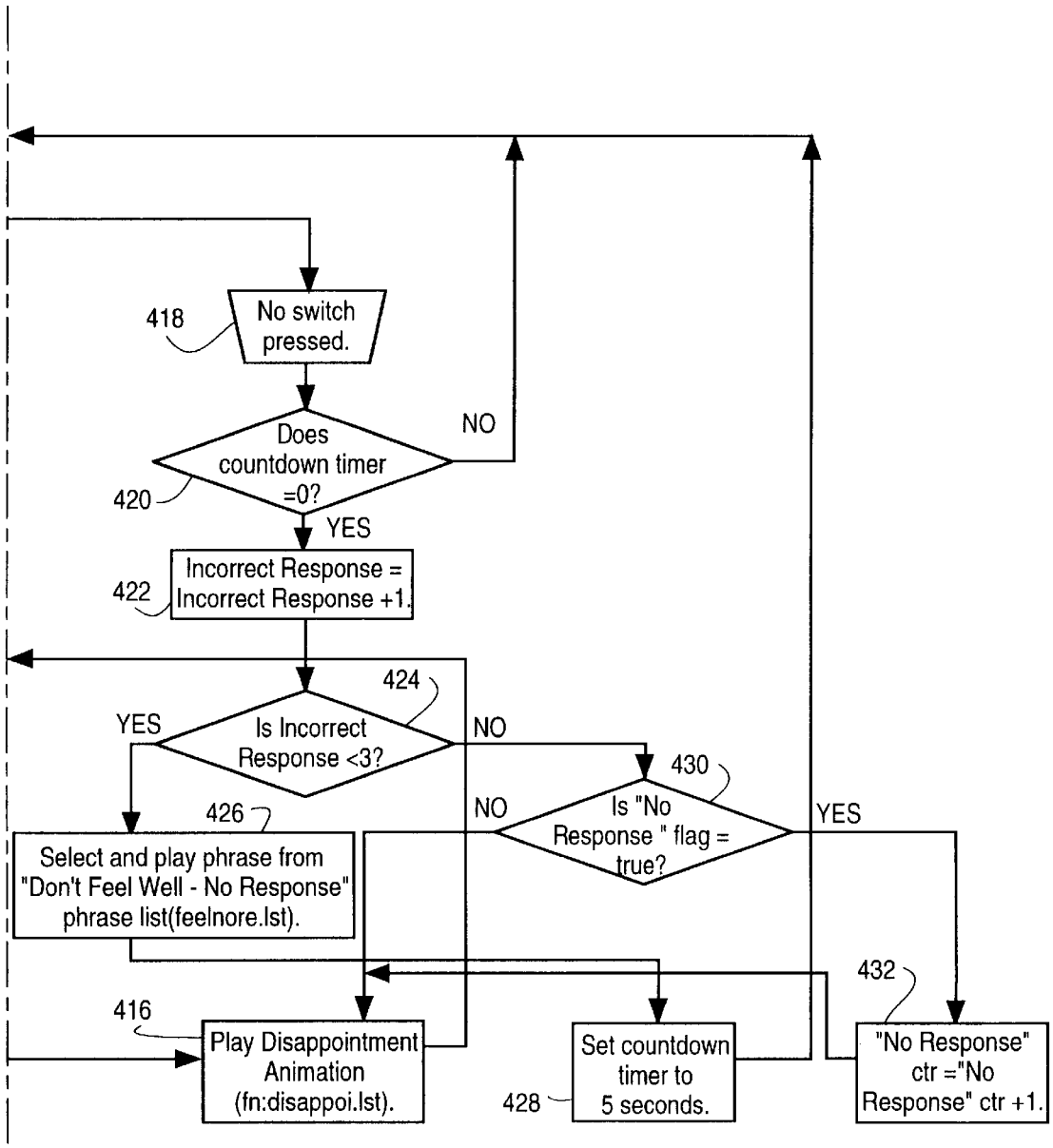

FIG. 15 is a flow chart diagram of the "feel-well" mode of operation. Upon entering the "feel-well" mode of operation (step 196), the LCD driver/CPU 26 selects a phrase from the "I-don't-feel-well" phrase list (step 384), commands the sound generator 20 to play the selected phrase (step 386) in synchronism with facial expressions animated on the LCD 20, sets the countdown timer (step 388), sets the no-response flag to true (step 390) and the LCD driver/CPU 26 scans switches 34–42 (step 392).

If the stomach switch 40 is activated (step 394), the no-response counter is reset to 0 (step 396), the LCD driver/CPU 26 selects a phrase from the "don't-feel-well-stomach" phrase list (step 398) and commands the sound generator 28 to play the selected phrase in synchronism with facial expressions animated on the LCD 20, and the plush toy 10 returns to the "activate a request" state (step 400).

If any of the mouth, back or side switches, 34, 36, 38 and 42, are activated (step 402), the no-response counter is incremented (step 404), the no-response flag is set to false (step 406), the incorrect response counter is incremented (step 408) and the LCD driver/CPU 26 determines if the incorrect response counter is less than 3 (step 410).

If the incorrect response counter is less than 3, the LCD driver/CPU 26 selects a phrase from the "don't-feel-well-incorrect" phrase list (step 412) and commands the sound generator 28 to play the selected phrase in synchronism with facial expressions animated by the LCD 20, the countdown timer is reset (step 414) and the LCD driver/CPU 26 re-scans switches 34–42 (step 392).

If the incorrect response counter is not less than 3, the LCD driver/CPU 26 determines if the no-response flag is true (step 430). If the no-response flag is true, the no-response counter is incremented, a disappointment animation is played on the LCD 20 (step 416) in synchronism with audible sounds played by the speaker 32, and the plush toy 10 returns to the "activate a request" state (step 400).

If the no-response flag is not true, a disappointment animation is played on the LCD 20 (step 416) in synchronism with audible sounds played by the speaker 32, and the plush toy 10 returns to the "activate a request" state (step 400), without incrementing the no-response counter.

As described, the reaction of the plush toy 10 to activation of a switch 34–42 is different for each mode of operation. Thus, the plush toy 10 appears lifelike in that it simulates different modes and its reaction to a child's actions vary as the plush toy 10 varies its mode of operation.

It will be apparent to those skilled in the art that modifications may be made without departing from the spirit and scope of the invention, Accordingly, it is not intended that the invention be limited except as may be necessary in view of the appended claims.

What is claimed is:

1. A selectively populated grid-matrix liquid crystal display for producing visual display patterns, the liquid crystal display comprising:

a light transmissive chamber including a top layer and a bottom layer connected together to form a sealed enclosure, said top and bottom layers each comprising inner and outer surfaces;

liquid crystal material positioned within said sealed enclosure;

a plurality of electrodes operably connected to said light transmissive chamber for applying an electrical potential across said liquid crystal material, said electrodes being arranged in a plane in a matrix pattern including a plurality of rows and a plurality of columns;

drive electronics operatively associated with a subset of said plurality of electrodes in select regions of the liquid crystal display for producing a plurality of pixels arranged in said select regions of the liquid crystal display such that only said select regions of the liquid crystal display are operable for producing the visual display patterns.

2. The liquid crystal display of claim 1 wherein said select regions of the liquid crystal display are separated from each other by areas which are not operable for producing the visual display patterns.

3. The liquid crystal display of claim 1 wherein said electrodes comprise:

electrically conductive light transmissive material operably connected to said inner surfaces of said top and bottom layers in predetermined patterns wherein the pattern of said electrically conductive material operably connected to said inner surface of said top layer mirrors the pattern of said electrically conductive material operably connected to said inner surface of said bottom layer.

4. The liquid crystal display of claim 1 further comprising top and bottom polarizer layers, said top polarizer layer being arranged on the outer surface of said top layer of said light transmissive chamber and said bottom polarizer layer being arranged on the outer surface of said bottom layer of said light tranmissive chamber.

5. The liquid crystal display of claim 4 wherein said top polarizer layer is light transmissive and said bottom polarizer layer is light reflective.

* * * * *